US011687041B2

(12) United States Patent
Tombez

(10) Patent No.: US 11,687,041 B2
(45) Date of Patent: Jun. 27, 2023

(54) TIMEPIECE COMPRISING A MECHANICAL OSCILLATOR WHEREIN THE MEDIUM FREQUENCY IS SYNCHRONISED ON THAT OF A REFERENCE ELECTRONIC OSCILLATOR

(71) Applicant: The Swatch Group Research and Development Ltd, Marin (CH)

(72) Inventor: Lionel Tombez, Bevaix (CH)

(73) Assignee: The Swatch Group Research and Development Ltd, Marin (CH)

( * ) Notice: Subject to any disclaimer, the term of this patent is extended or adjusted under 35 U.S.C. 154(b) by 1007 days.

(21) Appl. No.: 16/520,402

(22) Filed: Jul. 24, 2019

(65) Prior Publication Data

US 2020/0073331 A1 Mar. 5, 2020

(30) Foreign Application Priority Data

Sep. 4, 2018 (EP) ..... 18192469

(51) Int. Cl.
*G04C 11/08* (2006.01)
*G04B 17/06* (2006.01)

(52) U.S. Cl.
CPC ..... *G04C 11/081* (2013.01); *G04B 17/06* (2013.01)

(58) Field of Classification Search
CPC ..... G04C 11/081; G04C 3/069; G04B 17/06
(Continued)

(56) References Cited

U.S. PATENT DOCUMENTS 3,877,215 A 4/1975 Burckhardt et al.
2005/0036405 A1 2/2005 Born et al.
(Continued)

FOREIGN PATENT DOCUMENTS

CH 705679 A2 * 4/2013 ..... G04B 17/06
CH 709 279 A2 8/2015
(Continued)

OTHER PUBLICATIONS

European Search Report dated Feb. 8, 2019 in European Application 18192469.7 filed on Sep. 4, 2018 (wtih English Translation of Categories of Cited Documents).
(Continued)

*Primary Examiner* — Edwin A. Leon
*Assistant Examiner* — Kevin Andrew Johnston
(74) *Attorney, Agent, or Firm* — Oblon, McClelland, Maier & Neustadt, L.L.P.

(57) ABSTRACT

A mechanical oscillator, formed of a mechanical resonator and a device for maintaining oscillation, and an auxiliary oscillator forming a reference time base including a synchronisation device arranged to slave the medium frequency of the mechanical oscillator on that of the auxiliary oscillator. The synchronisation device includes an electromagnetic braking device which is formed of a coil and at least one permanent magnet and arranged such that an induced voltage is generated between the terminals of the coil in each alternation of the oscillation of the mechanical resonator. The synchronisation device is arranged to be able to reduce momentarily the impedance between the terminals of the coil during distinct time intervals, any two successive time intervals exhibiting between the respective starts thereof a time distance substantially equal to a positive whole number multiplied by half of a set-point period for the mechanical oscillator.

14 Claims, 24 Drawing Sheets

(58) Field of Classification Search
USPC ..... 368/76
See application file for complete search history.

(56) References Cited

U.S. PATENT DOCUMENTS

| | | | | |
|---|---|---|---|---|
| 2005/0073913 | A1* | 4/2005 | Born | G04C 10/00 368/127 |
| 2007/0201317 | A1* | 8/2007 | Houlon | G04C 5/005 368/281 |
| 2018/0181073 | A1* | 6/2018 | Tombez | G04C 9/08 |

FOREIGN PATENT DOCUMENTS

| | | | | |
|---|---|---|---|---|
| CH | 713306 | A2 * | 6/2018 | G04B 17/20 |
| CN | 1603980 | A | 4/2005 | |
| CN | 106062644 | A | 10/2016 | |
| CN | 106444337 | A | 2/2017 | |
| FR | 2 162 404 | A1 | 7/1973 | |
| FR | 2 210 787 | A1 | 7/1974 | |
| JP | 49-66161 | A | 6/1974 | |
| JP | 2005-106829 | A | 4/2005 | |

OTHER PUBLICATIONS

Japanese Office Action dated Oct. 13, 2020 in Japanese Patent Application No. 2019-153408 (with English translation), 7 pages.
Combined Chinese Office Action and Search Report dated Nov. 2, 2020 in Chinese Patent Application No. 201910827874.7 (with English translation), 13 pages.

* cited by examiner

TIMEPIECE COMPRISING A MECHANICAL OSCILLATOR WHEREIN THE MEDIUM FREQUENCY IS SYNCHRONISED ON THAT OF A REFERENCE ELECTRONIC OSCILLATOR

CROSS-REFERENCE TO RELATED APPLICATION

This application claims priority to European Patent Application No. 18192469.7 filed on Sep. 4, 2018, the entire disclosure of which is hereby incorporated herein by reference.

TECHNICAL FIELD

The present invention relates to a timepiece comprising a mechanical movement wherein the running is enhanced by a device for correcting a potential time drift in the operation of the mechanical oscillator which times the running of the mechanical movement. The timepiece comprises a mechanical oscillator wherein the medium frequency is synchronised on a set-point frequency determined by an auxiliary electronic oscillator.

In particular, the timepiece is formed, on one hand, by a mechanical movement comprising:

- an indicator mechanism of at least one time data item,
- a mechanical resonator suitable for oscillating along a general oscillation axis about a neutral position corresponding to the minimum potential energy state thereof,
- a maintenance device of the mechanical resonator forming therewith a mechanical oscillator which is arranged to time the running of the indicator mechanism, and, on the other hand, by a synchronisation device arranged to slave the medium frequency of the mechanical oscillator on a set-point frequency determined by a reference time base.

TECHNOLOGICAL BACKGROUND

Timepieces as defined in the field of the invention have been proposed in some prior documents. The patent CH 597 636, published in 1977, proposes such a timepiece with reference to FIG. 3 thereof. The movement is equipped with a resonator formed by a balance-hairspring and a conventional maintenance device comprising a pallet assembly and an escapement wheel kinematically linked with a barrel equipped with a spring. This timepiece movement further comprises a device for regulating the frequency of the mechanical oscillator thereof. This regulation device comprises an electronic circuit and an electromagnetic braking formed from a flat coil, arranged on a support arranged under the felloe of the balance, and from two magnets mounted on the balance and arranged close to one another so as to both pass over the coil when the oscillator is activated.

The electronic circuit comprises a time base comprising a quartz generator and serving to generate a reference frequency signal FR, this reference frequency being compared with the frequency FG of the mechanical oscillator. The frequency FG of the oscillator is detected via the electrical signals generated in the coil by the pair of magnets. The comparison between the two frequencies FG and FR is carried out by a bidirectional counter receiving at the two inputs thereof these two frequencies and outputting a signal determining a difference of periods counted for the two frequencies. The electronic circuit further comprises a logic circuit which analyses the output signal of the counter to control a braking pulse application circuit according to this output signal, so as to brake the balance when the logic circuit has detected a time drift corresponding to a value of the frequency FG of the oscillator greater than the reference frequency FR. The braking pulse application circuit is suitable for inducing a momentary braking torque on the balance via an electromagnetic magnet-coil interaction and a switchable load connected to the coil.

SUMMARY OF THE INVENTION

An aim of the present invention is that of simplifying as much as possible the electronic circuit of a synchronisation device arranged to slave the medium frequency of the mechanical oscillator of a mechanical movement on a set-point frequency determined by an auxiliary electronic oscillator, without for all that losing precision in the running of the timepiece equipped with such a synchronisation device.

Within the scope of the present invention, it is sought generally to enhance the precision of the running of a mechanical timepiece movement, i.e. reduce the maximum daily error of this mechanical movement and more globally reduce very significantly a possible time drift over a longer period (for example a year). In particular, the present invention seeks to achieve such an aim for a mechanical timepiece movement wherein the running is initially optimally adjusted. Indeed, a general aim of the invention is that of finding a device for correcting the running of a mechanical movement for the case where the natural operation of this mechanical movement would result in a certain daily error and consequently an increasing time drift (increasing cumulative error), without for all that renouncing on being able to function autonomously with the best possible precision that it can have by means of the specific features thereof, i.e. in the absence of the correction device or when the latter is inactive.

To this end, the present invention relates to a timepiece as defined in the field of the invention and wherein the synchronisation device comprises an electromagnetic braking device of the mechanical resonator, this electromagnetic braking device being formed of at least one coil and at least one permanent magnet which are arranged such that an induced voltage is generated between the two terminals of the coil in each alternation of the oscillation of the mechanical resonator for a usable operating range of the mechanical oscillator, the synchronisation device being arranged to be able to momentarily reduce the impedance between the two terminals of the coil. The timepiece is remarkable in that the synchronisation device is arranged so as to reduce the impedance between the two terminals of the coil during distinct time intervals $T_P$ and such that the starts of any two successive time intervals, among the distinct time intervals, exhibit therebetween a time distance $D_T$ equal to a positive whole number N multiplied by half of a set-point period $T0_C$ for the mechanical oscillator, i.e. $D_T = N \cdot T0_C/2$. In particular, the synchronisation device is arranged to determine by means of the reference time base the start of each of the distinct time intervals so as to fulfil the mathematical relation mentioned above between the time distance $D_T$ and the set-point period $T0_C$.

By means of the features of the invention, surprisingly, the mechanical oscillator of the timepiece movement is slaved to the auxiliary oscillator effectively and rapidly, as will become apparent from the detailed description of the invention hereinafter. The oscillation frequency of the mechanical oscillator (slave mechanical oscillator) is synchronised on the set-point frequency determined by the auxiliary oscillator (master oscillator), without closed-loop servo-control and without requiring a measurement sensor of the oscillation movement of the mechanical oscillator. The synchronisation device therefore functions with an open loop and makes it possible to correct both an advance and a delay in the natural running of the mechanical movement, as will be explained hereinafter. This result is absolutely remarkable.

The term 'synchronisation on a master oscillator' denotes a servo-control (open-loop, therefore with no feedback) of the slave mechanical oscillator to the master oscillator. The operation of the synchronisation device is such that the frequency at which the time intervals occur, where the impedance of the circuit connected to the two terminals of the coil is reduced, is forced on the slave mechanical oscillator which times the running of the time data item indicator mechanism. More generally, it is not even necessary for the succession of such distinct time intervals to occur periodically at a given frequency, since it is simply necessary for the starts (or, equivalently, the midpoint times) of any two successive time intervals among these distinct time intervals to exhibit therebetween a time distance $D_T$ as defined above, with a positive whole number N that may vary over time. This does not consist herein of the standard case of a forced oscillator, or even of the scenario of coupled oscillators.

In the present invention, the possible time distances $D_T$, for a predefined set-point period $T0_C$, determine the medium frequency of the mechanical oscillator and therefore the timing of the mechanism. As the time distances are determined by a specific auxiliary oscillator, the medium frequency is determined by this auxiliary oscillator such that the precision of the running of the mechanism is directly correlated with that of the auxiliary oscillator. The term 'time the running of a mechanism' denotes setting the pace of the movement of the moving parts of this mechanism when operating, in particular determining the rotational speeds of the wheels thereof and thus of at least one indicator of a time data item.

In a main embodiment, the mechanical resonator is formed by a balance oscillating about an oscillation axis, and the synchronisation device is arranged to trigger periodically the distinct time intervals $T_P$, which have the same value, and such that the triggering frequency $F_D$ of these distinct time intervals equals twice a set-point frequency $F0_C$, equal by definition to the inverse of the set-point period $T0_C$, divided by a positive whole number M, i.e. $F_D=2\cdot F0_C/M$, the value of the distinct time intervals $T_P$ being less than the set-point half-period, i.e. $T_P<T0_C/2$. In a preferred alternative embodiment, the value of the distinct time intervals $T_P$ is envisaged less than one quarter of the set-point period $T0_C$, i.e. $T_P<T0_C/4$.

BRIEF DESCRIPTION OF THE FIGURES

The invention will be described in detail hereinafter using the appended drawings, given by way of examples that are in no way limiting, wherein.

DETAILED DESCRIPTION OF THE INVENTION

Figure 1:
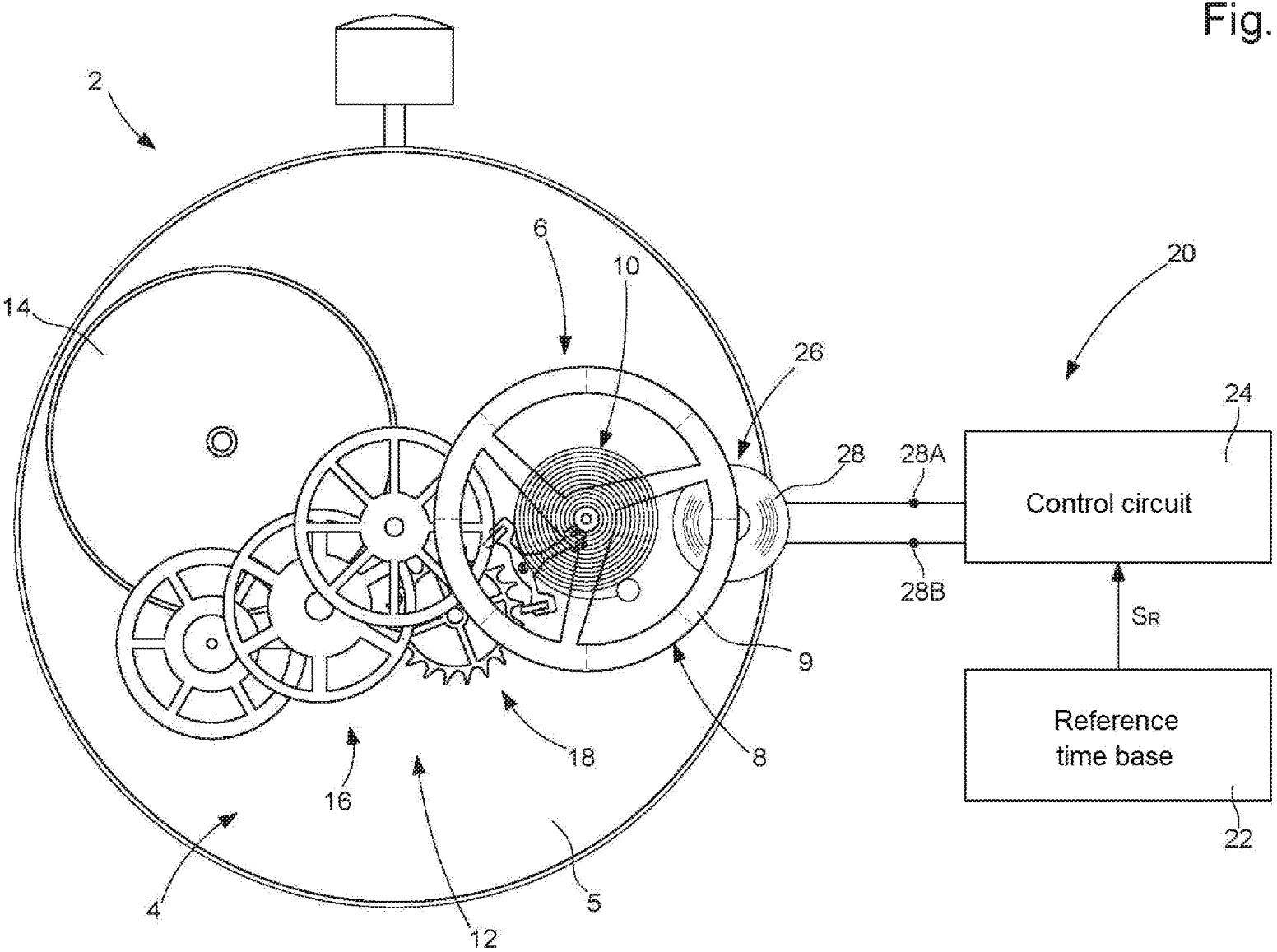
FIG. 1 shows a first embodiment of a timepiece according to the invention.
Figure 2:
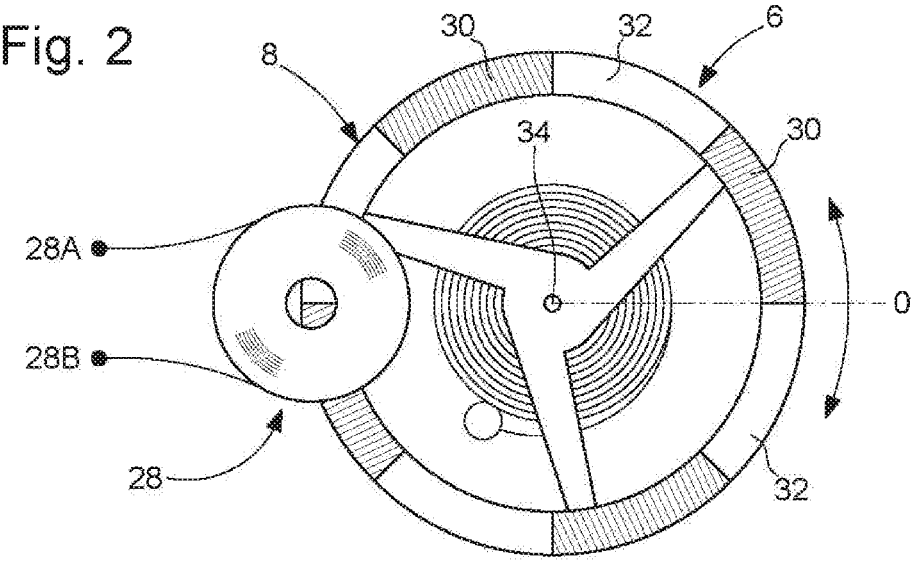
FIG. 2 is a partial view of the first embodiment according to FIG. 1.

A first embodiment of a timepiece according to the invention will be described with reference to FIGS. 1 to 4 and 5A to 5C. In FIG. 1 is represented, in part schematically, a timepiece 2 comprising a mechanical movement 4 which includes at least one indicator mechanism 12 of a time data item. The mechanism 12 comprises a gear train 16 actuated by a barrel 14 (the mechanism is represented partially in FIG. 1). The mechanical movement further comprises a mechanical resonator 6, formed by a balance 8 and a hairspring 10, which is arranged on a plate 5 defining a support of the mechanical resonator, and a device for maintaining this mechanical resonator which formed by an escapement 18, this maintenance device forming with this mechanical resonator a mechanical oscillator which times the running of the indicator mechanism. The escapement 18 conventionally comprises a pallet assembly and an escape wheel, the latter being kinematically linked with the barrel via the gear train 16. The mechanical resonator is suitable for oscillating, about a neutral position (idle position/zero angular position) corresponding to the minimum potential energy state thereof, along a circular axis (the radius of this axis is not important since the position of the balance along this axis is given by an angle). The circular axis defines a general oscillation axis which indicates the nature of the movement of the mechanical resonator, which may be for example linear in a further embodiment.

Each oscillation of the mechanical resonator defines an oscillation period which is formed to two alternations, each between two end angular positions of the oscillation and with a rotation in the opposite direction of the other. When the mechanical resonator reaches an end angular position, defining the oscillation amplitude, the rotational speed thereof is zero and the direction of rotation is inverted. Each alternation has two half-alternations (the duration whereof may be different according to disturbing events), i.e. a first half-alternation occurring before the passage of the mechanical resonator via the neutral position thereof and a second half-alternation occurring after this passage via the neutral position thereof.

The timepiece 2 comprises a device 20 for synchronising the mechanical oscillator, formed of the mechanical resonator 6 and the escapement 18, on a reference time base 22 formed by an auxiliary oscillator which comprises a quartz resonator 35 and a clock circuit 36 maintaining the quartz resonator and delivering a reference frequency signal $S_R$. The quartz oscillator defines a master oscillator. The reference time base is associated with the control device 24 of the synchronisation device to which it supplies the signal $S_R$. It should be noted that further types of auxiliary oscillators may be envisaged, particularly an oscillator integrated entirely in an electronic circuit with the control circuit. Generally, the auxiliary oscillator is by nature or by design more precise than the mechanical oscillator arranged in the timepiece movement, this mechanical oscillator defining a slave oscillator within the scope of the invention. As a general rule, as will be understood hereinafter, the synchronisation device 20 is arranged to slave the medium frequency of the mechanical oscillator on a set-point frequency determined by the auxiliary oscillator.

Then, the synchronisation device 20 comprises an electromagnetic braking device 26 of the mechanical resonator 6. The term 'electromagnetic braking' denotes a braking of the mechanical resonator generated via an electromagnetic interaction between at least one permanent magnet, borne by the mechanical resonator or a support of this mechanical resonator, and at least one coil borne respectively by the support or the mechanical resonator and associated with an electronic circuit wherein a current induced in the coil by the magnet may be generated. As a general rule, the electromagnetic braking device is thus formed of at least one coil 28 and at least one permanent magnet which are arranged such that an induced voltage is generated between the two terminals 28A, 28B of the coil 28 in each alternation of the oscillation of the mechanical resonator for a usable operating range of the mechanical oscillator. The coil 28 is of the wafer type (disc having a height less than the diameter thereof), with no ferromagnetic core. In the first embodiment, there is envisaged a plurality of bipolar magnets 30, 32 which are arranged in a juxtaposed manner on the felloe 9 of the balance with an alternation of the magnetic polarities along the direction of the oscillation axis 34. In an equivalent alternative embodiment, there is envisaged an annular magnet having an axial magnetisation with successive sectors corresponding to the bipolar magnets 30, 32, these successive sectors having alternating polarities and each defining an angle at the centre (an angular 'aperture') having substantially the same value. In the alternative embodiment represented, the bipolar magnets 30, 32 define eight magnetised annular sectors each having an angular distance of 45° with alternating magnetic polarities. In the case of the first embodiment, there is an even number 2N of magnetised annular sectors, N being a positive whole number, these sectors being arranged in a circular manner, particularly on the felloe 9 of the balance 8 forming the mechanical resonator 6.

The coil 28 is arranged on the plate 5 so as to be traversed by the magnetic flux from the bipolar magnets/magnetised annular sectors when the balance oscillates. Advantageously, the diameter of the coil 28 is envisaged such that it is substantially included in an angular aperture, relative to the oscillation axis, which is substantially equal to that defined by each bipolar magnet/magnetised annular sector.

However, in further alternative embodiments, the diameter of the coil 28 may be envisaged greater and have for example an angular aperture corresponding substantially to double that of a magnetised annular sector. Furthermore, in a further alternative embodiment, there is envisaged a plurality of wafer coils exhibiting therebetween, pairwise, an angular lag corresponding to a whole number of magnetic periods (a magnetic period being given by the angular distance of two adjacent magnetised annular sectors). These coils thus not having an electromagnetic phase shift (i.e. the phase shifts are whole multiples of 360°), the induced voltages in these coils each have a variation over time identical and simultaneously to the others, such that the induced voltage are added together. The plurality of coils may be arranged in series or in parallel. The number of magnetised annular sectors, the number of coils and the characteristic dimensions thereof are selected according to the strength of the electromagnetic interaction sought to enable the desired servo-control of the mechanical oscillator.

According to the invention, the synchronisation device is arranged to be able to momentarily reduce the impedance between the two terminals of the coil. According to a general synchronisation mode implemented in the synchronisation device according to the invention, the latter is arranged so as to reduce the impedance between the two terminals of the coil during distinct time intervals $T_P$ and such that the respective starts of any two successive time intervals, among these distinct time intervals, exhibit therebetween a time distance $D_T$ equal to a positive whole number N multiplied by half of a set-point period $T0_C$ (i.e. by a set-point half-period) for the mechanical oscillator, i.e. $D_T=N\cdot T0_C/2$. The synchronisation device is arranged to determine by means of the reference time base 22 the start of each of the distinct time intervals so as to fulfil the mathematical relation mentioned above between the time distance $D_T$ and the set-point period $T0_C$.

In the embodiments described, the mechanical resonator is formed by a balance rotating about an oscillation axis. In the synchronisation modes implemented in the synchronisation devices represented in FIGS. 5A to 5C and 28A to 28C, it is envisaged to trigger periodically the distinct time intervals $T_P$ during which the impedance between the terminals of the coil is reduced, i.e. these time intervals are envisaged with a time distance $T_D$ therebetween which is constant. The triggering frequency $F_D$ of these distinct time intervals equals twice the set-point frequency $F0_C$, equal by definition to the inverse of the set-point period $T0_C$, divided by a positive whole number M, i.e. $E_D=2\cdot F0_C/M$. Then, preferably, the distinct time intervals $T_P$ have the same value which is envisaged less than the set-point half-period, i.e. $T_P<T0_C/2$. Finally, the synchronisation device is arranged so as to generate a short-circuit between the two terminals 28A and 28B of the coil 28 during the distinct time intervals $T_P$ to reduce the impedance between the two terminals of this coil.

Figure 5A:
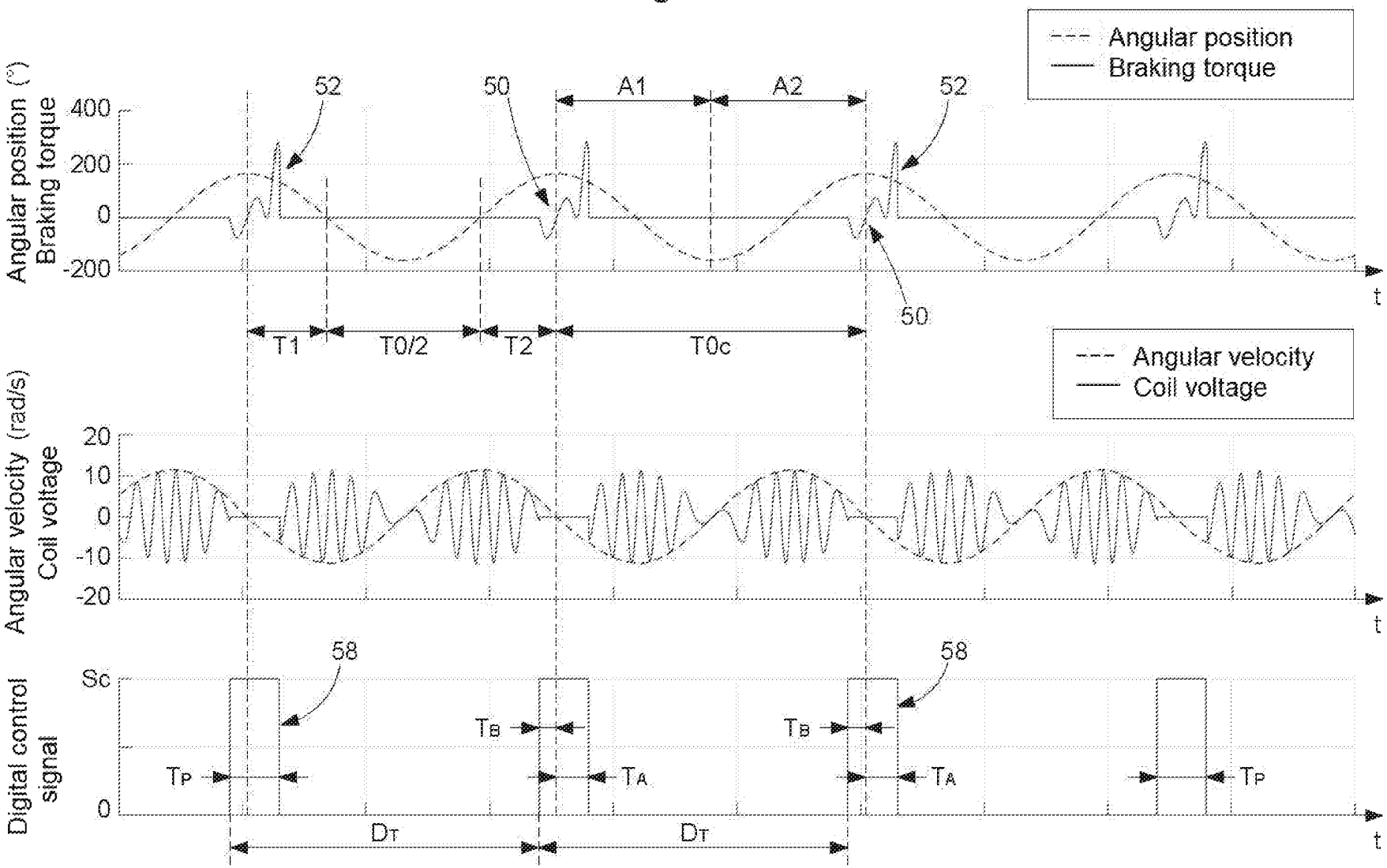
FIGS. 5A, 5B and 5C are graphs providing the progression over time of various physical parameters of the mechanical oscillator and of the synchronisation device of the first embodiment for various relations between the set-point frequency $F0_C$ and the natural frequency F0 of the mechanical oscillator, respectively $F0>F0_C$, $F0<F0_C$, $F0=F0_C$.
Figure 5B:
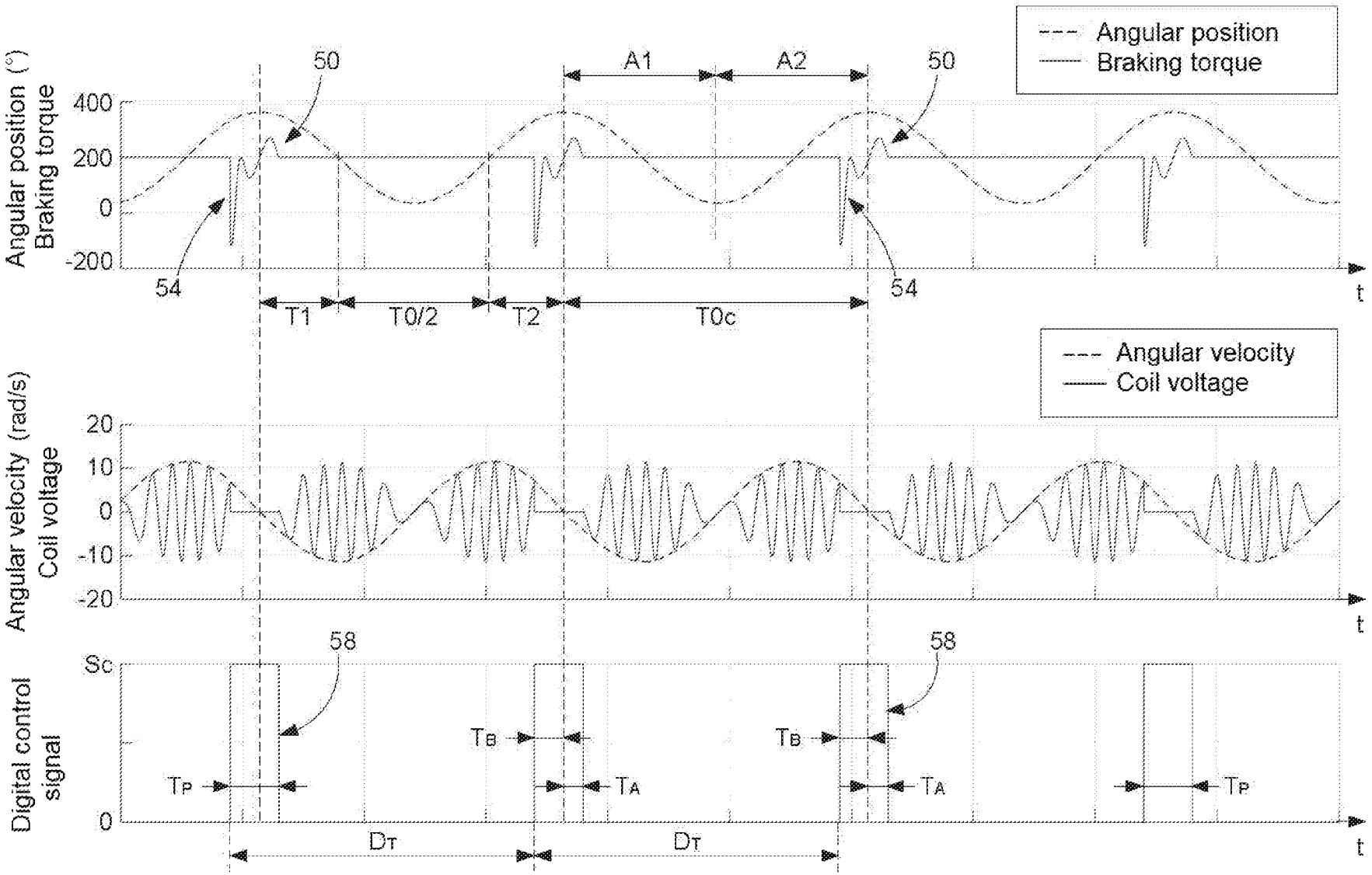
Figure 5C:
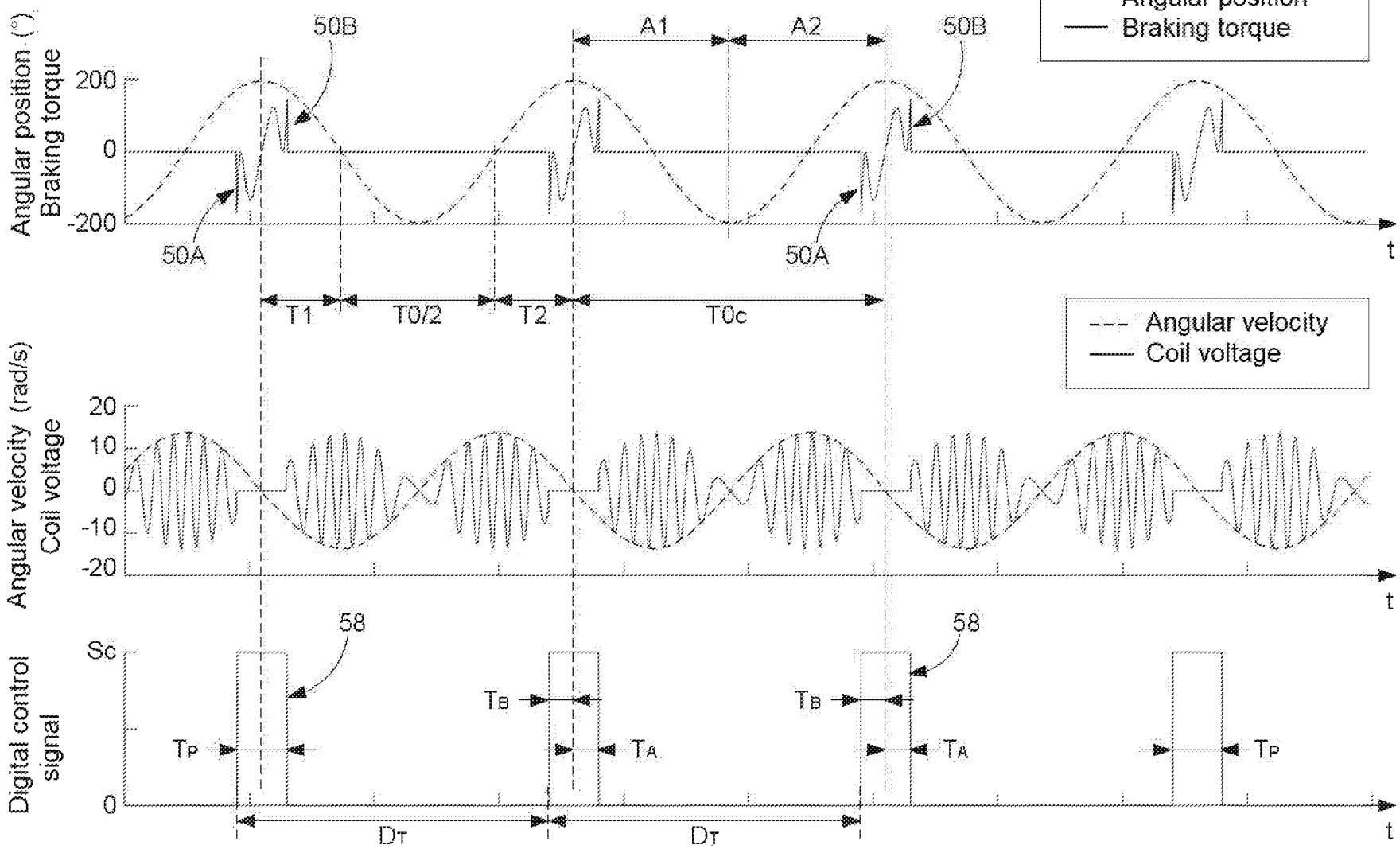

In the alternative embodiment of the first embodiment described with the aid of FIGS. 5A to 5C, the whole number M equals two (M=2), such that the triggering frequency $F_D$ is equal to the set-point frequency $F0_C$ and the successive time distances $T_D$ are equal to the set-point period $T0_C$. Then, the value of the distinct time intervals $T_P$ is advantageously less than one quarter of the set-point period $T0_C$, i.e. $T_P<T0_C/4$. In this first embodiment, as can be seen in FIGS. 5A to 5C, the electromagnetic device 26 is arranged such that an induced voltage is generated in the coil 28 substantially continuously for any oscillation of the mechanical resonator 6 within the usable operating range of the mechanical oscillator formed by this mechanical resonator.

Before considering FIGS. 5A to 5C in more detail, the behaviour of a mechanical oscillator subject to braking pulses of short duration will be firstly summarised herein, although a more detail description on this topic is given hereinafter. It is observed that, when the braking pulse is generated between the start of an alternation and the passage of the resonator via the neutral position thereof in this alternation, such a braking pulse induces a negative time phase shift in the oscillator of the resonator. Thus, the duration of the alternation in question is increased relative to the duration T0/2 of an alternation during the natural oscillation of the mechanical oscillator. This induces therefore an isolated decrease in the frequency of the mechanical oscillator and makes it possible to induce a certain delay in the running of the timepiece to correct, if needed, an advance adopted by this mechanical oscillator. On the other hand, when the braking pulse is generated between the passage of the resonator via the neutral position thereof in an alternation and the end of this alternation, such a braking pulse induces a positive time phase shift in the oscillator of the resonator. Thus, the duration of the alternation in question is reduced relative to the duration T0/2 of an alternation during the natural oscillation of the mechanical oscillator. This induces therefore an isolated increase in the frequency of the mechanical oscillator and makes it possible to induce a certain advance in the running of the timepiece to correct, if needed, a delay adopted by this mechanical oscillator.

In FIGS. 5A to 5C are represented, in a stable phase of the synchronisation obtained by the synchronisation device according to the invention, the curves of the angular position and the angular velocity of the balance-hairspring 6 as well as a digital control signal $S_C$ generated in the control circuit 24 and supplied to a switch 40 arranged to short-circuit the two terminals 28A, 28B of the coil 28 (see FIGS. 3 and 4) during pulses 58 defining the distinct time intervals $T_P$. Furthermore, in these figures are represented a signal of the induced voltage in the coil 28, resulting from the oscillation of the mechanical resonator 6 and the short-circuit pulses 58, and a signal of the braking torque applied to the mechanical resonator during the short-circuit pulses. It should be noted that the stable phase represented herein occurs following a transitory phase (initial phase) described hereinafter. Remarkably, during the stable phase, also known as the synchronous phase, the oscillation frequency of the mechanical resonator is slaved to the set-point frequency $F0_C$ and the first and second parts $T_B$ and $T_A$ of the short-circuit pulses 58 have a substantially constant and defined ratio. In this stable phase, the synchronisation device stabilises automatically, with no sensor measuring a parameter of the oscillation of the mechanical resonator 6 and with no feedback loop, the oscillation frequency of this mechanical resonator at the set-point frequency $F0_C$.

FIG. 5A corresponds to a scenario where the natural frequency F0 of the mechanical oscillator of the timepiece is greater than the set-point frequency $F0_C$, such that this timepiece without the synchronisation device would exhibit a positive time drift corresponding to an advance in the running of the timepiece. It is observed that the short-circuit pulses 58 occur about an end angular position, i.e. the distinct time intervals $T_P$ include an inversion of the direction of the oscillation movement occurring between an alternation A2 and an alternation A1 of the oscillation while the rotational speed (angular velocity) is zero. The oscillation periods are equal to the set-point period $T0_C$, but it is noted that the two alternations A1 and A2 forming each oscillation period are not equal. Indeed, the alternation A1 lasts herein longer than the alternation A2, as greater braking occurs in the alternation A1, before the passage of the mechanical resonator via the neutral position thereof (angle 0°), than in the alternation A2 after the passage of the mechanical resonator via the neutral position thereof. It should be noted that no braking torque is applied to the mechanical resonator or after the passage of the mechanical resonator via the neutral position thereof in the alternation A1, or before the passage of the mechanical resonator via the neutral position thereof in the alternation A2.

The braking pulse is formed of two small lobes 50 situated respectively on either side of the time of the passage of the mechanical resonator via the end angular position thereof, exhibiting a central symmetry relative to this time (the opposite mathematical signs of the two lobes 50 stem from the change of direction in the oscillation movement), and of a lobe 52 of greater amplitude occurring in the alternation A1 of each oscillation period, in the first half-alternation before the passage of the mechanical resonator via the neutral position thereof. The effects of the two lobes 50 compensate one another and therefore do not generate overall any phase shift in the oscillation of the mechanical resonator, while the braking torque caused by the lobe 52 in each alternation A1 induces an increase in the duration thereof, such that the duration of the oscillation period in question is equal to that of the set-point period $T0_C$. The instantaneous oscillation frequency is thus equal to the set-point frequency $F0_C$ which is, as indicated, less than the natural frequency F0 of the mechanical oscillator. The appearance of the lobe 52 merely in the alternations A1 results from the fact that the midpoint times of the short-circuit pulses 58 occur with a certain delay relative to the passages of the mechanical resonator via an end angular position thereof, this stemming from the fact that the natural frequency F0 of the mechanical oscillator is greater than the set-point frequency $F0_C$. Indeed, the part $T_B$ of the pulses 58 occurring before the passage of the mechanical resonator via an end position is less than the part $T_A$ of the pulses 58 occurring after this passage.

FIG. 5B corresponds to a scenario where the natural frequency F0 of the mechanical oscillator of the timepiece is less than the set-point frequency $F0_C$, such that this timepiece without the synchronisation device would exhibit a negative time drift corresponding to a delay in the running of the timepiece. It is once again observed that the short-circuit pulses 58 occur about an end angular position and that the alternation A1 lasts longer than the alternation A2, as greater braking occurs in the alternation A2, herein after the passage of the mechanical resonator via the neutral position thereof (angle 0°), than in the alternation A1 before the passage of the mechanical resonator via the neutral position thereof. As in the preceding scenario, no braking torque is applied to the mechanical resonator either after the passage of the mechanical resonator via the neutral position thereof in the alternation A1, or before the passage of the mechanical resonator via the neutral position thereof in the alternation A2. The braking pulse is formed herein of the two small lobes 50 situated respectively on either side of the end angular position and of a lobe 54 of greater amplitude occurring in the alternation A2 of each oscillation period, in the second half-alternation after the passage of the mechanical resonator via the neutral position thereof.

The effects of the two lobes 50 still compensate one another, while the braking torque caused by the lobe 54 in each alternation A2 induces a decrease in the duration thereof, such that the duration of the oscillation period in question is equal to that of the set-point period $T0_C$. The instantaneous oscillation frequency is thus equal to the set-point frequency $F0_C$ which is, as indicated, greater than the natural frequency F0 of the mechanical oscillator. The appearance of the lobe 54 merely in the alternations A2 results from the fact that the midpoint times of the short-circuit pulses 58 occur herein with a certain advance relative to the passages of the mechanical resonator via an end angular position thereof, this stemming from the fact that the natural frequency F0 of the mechanical oscillator is less than the set-point frequency $F0_C$. Indeed, the part $T_A$ of the pulses 58 occurring after the passage of the mechanical resonator via an end position is less than the part $T_B$ of the pulses 58 occurring before this passage.

In order to be comprehensive, there is represented in FIG. 5C a scenario where the natural frequency F0 of the mechanical oscillator of the timepiece is equal to the set-point frequency $F0_C$. There results from this scenario that the part $T_A$ of the pulses 58 occurring after the passage of the mechanical resonator via an end angular position is equal to the part $T_B$ of the pulses 58 occurring before this passage, such that the parts 50A of the braking pulses occurring in the alternations A2 immediately before the passage of the mechanical resonator via an end position thereof have the same profile, with an opposite mathematical sign, as the part 50B of the braking pulses occurring in the alternations A1 immediately after this passage and thus exhibiting a central symmetry relative to the time of the passage via the end angular position in question. Consequently, the effects of the parts 50A and 50B of the braking pulses occurring in the course of each short-circuit pulse 58, and therefore of each distinct time interval $T_P$, compensate one another mutually such that, in this particular case, the synchronisation device does not affect the running of the timepiece, which is precise insofar as it is naturally synchronous with the reference time base 22.

Figure 3:
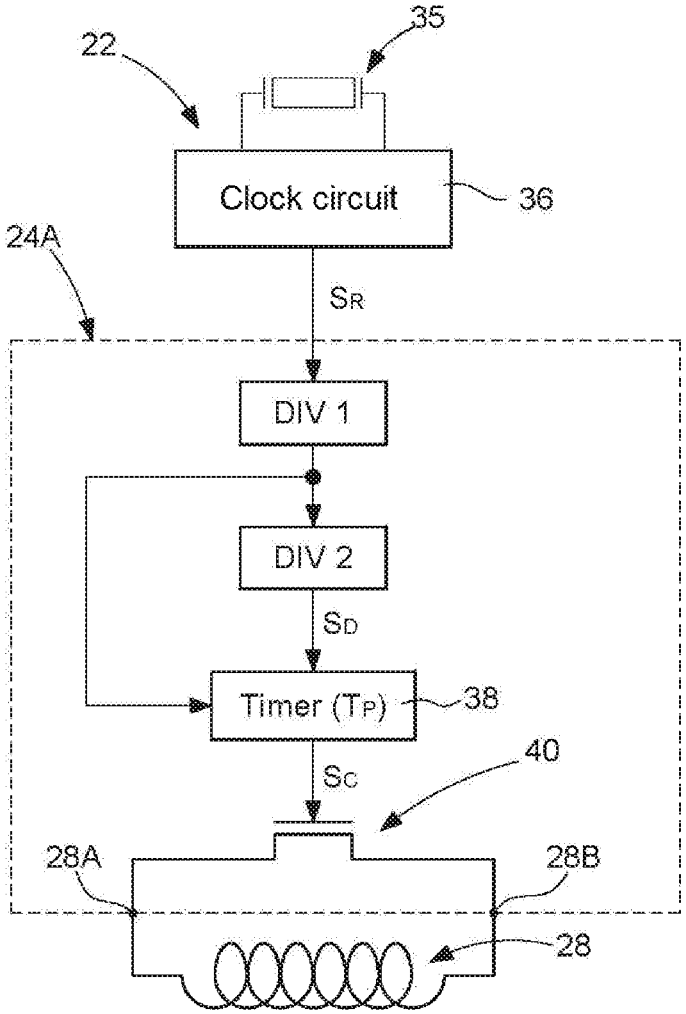
FIG. 3 shows the electronic diagram of a first alternative embodiment of the control circuit of the electromagnetic braking device according to the invention.

FIG. 3 is a diagram showing a first alternative embodiment 24A of the control circuit 24 of the synchronisation device 20. The control circuit 24A is connected on one hand to the clock circuit 36 and, on the other, to the coil 28. The clock circuit maintains the quartz resonator 35 and generates in return a clock signal $S_R$ at a reference frequency, particularly equal to $2^{15}$ Hz. The clock signal $S_R$ is supplied successively to two splitters DIV1 and DIV2 (these two splitters being capable of forming two stages of the same splitter). The Splitter DIV2 supplies a periodic signal $S_D$ directly to a timer 38 (Timer). On each detection of a characteristic transition in the periodic signal $S_D$, the timer renders conducting the switch 40 for a time interval $T_P$, to short-circuit the coil 28, by supplying same with a control signal $S_C$, having a triggering frequency $F_D$ identical to that of the periodic signal $S_D$, which triggers periodically the timer 38. As the duration of the braking pulses (corresponding to that of the short-circuit pulses) is envisaged herein less than $T0_C/4$ (for example $T0_C$=250 ms) and even considerably less than this value in the case in question, particularly between 10 ms and 30 ms, the timer 38 receives a timing signal from the splitter DIV1.

For example, in the case of a set-point frequency $F0_C$=4 Hz and a triggering frequency $F_D$ equal to this set-point frequency, as in the example given in FIGS. 5A to 5C, the splitter DIV2 supplies the triggering pulses directly to the timer at the frequency $E_D$=4 Hz. If it is envisaged to supply a short-circuit pulse every second, i.e. every four oscillation periods, and thus have a time distance $D_T$=1 s between the distinct time intervals $T_P$ where the impedance between the terminals 28A and 28B of the coil is reduced, then the terminal output of a conventional timepiece splitting circuit may be used which supplies, at the output of the terminal stage of the chain for splitting by two, a periodic signal at the frequency of 1 Hz. For a triggering frequency $F_D$=4 Hz mentioned above, a conventional timepiece splitter circuit may also be used, but adopting as the output the signal supplied two stages before the terminal output in the splitting chain. It should be noted that the control circuit 24A of the synchronisation device is very simple. It can be miniaturised easily and the electrical consumption thereof is very low. No microcontroller is required.

It should be noted that in a particular synchronisation mode, it may be envisaged to generate short-circuit pulses in groups, for example a succession of sequences with four pulses in four successive oscillation periods then no pulse for ten seconds, i.e. for forty periods for a frequency $F0_C$=4 Hz. In a further synchronisation mode, it may be envisaged to vary the time intervals $T_P$ (therefore the duration of the short-circuit pulses), for example by envisaging a longer duration in an initial phase, to induce a greater braking torque, than in a subsequent nominal state. It should be noted that the synchronisation method is robust. For example, it is not necessary for the time intervals $T_P$ to be measured precisely, i.e. with the same amount of precision as the time distances $D_T$ between the starts of these time intervals. Thus, there may be envisaged a timer with its own timing circuit, less precise than the reference time base 22.

Figure 4:
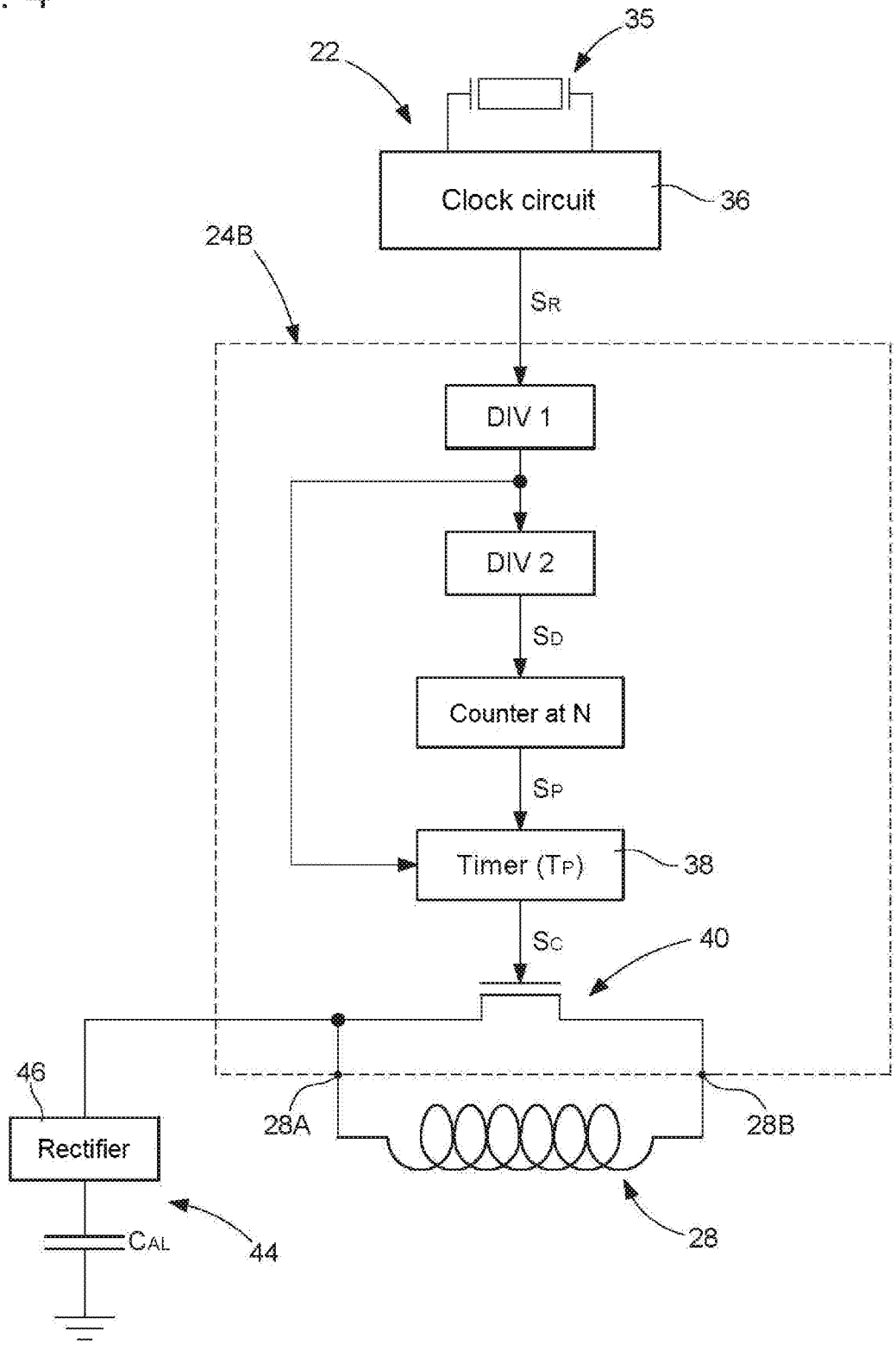
FIG. 4 shows the electronic diagram of a second alternative embodiment of the control circuit of the electromagnetic braking device according to the invention.

In a second alternative embodiment 24B, shown in FIG. 4, of the control circuit 24 of the synchronisation device 20, the splitters DIV1 and DIV2 form together a conventional timepiece splitter circuit which therefore supplies as an output a periodic signal $S_D$ having a frequency equal to 1 Hz. This signal $S_D$ is supplied to a counter at N which defines an additional splitter, which generates the periodic signal $S_D$ that it supplies to the timer 38. The control signal $S_C$ supplied by the timer to the switch 40 has a triggering frequency $F_D$ equal to that of the periodic signal $S_P$. Thus, in an example where the set-point frequency $F0_C$ of the mechanical oscillator is equal to 4 Hz ($F0_C$=4 Hz) and the number N is equal to eight, the triggering frequency $F_D$ of the periodic signals $S_P$ and $S_C$ is then ⅛ Hz, which means that there is envisaged one braking pulse (short-circuit pulse) per 32 set-point periods $T0_C$, i.e. about one pulse after 32 periods of the mechanical oscillator insofar as the natural frequency F0 is envisaged close to the set-point frequency $F0_C$.

In FIG. 4, the synchronisation device further comprises a power supply device 44 formed by a rectifier circuit 46 (of the single or double alternation type) and by a storage capacitor $C_{AL}$ connected to the ground (reference potential of the synchronisation device). The rectifier circuit is constantly connected at the input to a terminal of the coil such that outside the short-circuit pulses, it can rectify a voltage induced in the coil 28 by the permanent magnets 30, 32. This induced voltage rectified and stored in the storage capacitor serves for the electrical power supply of the synchronisation device within the usable operating range of the mechanical oscillator. The control circuit 24B of the synchronisation device is very simple and autonomous. It has a low consumption and takes minimum energy from the mechanical oscillator to carry out the synchronisation according to the invention effectively.

There will be described hereinafter, with reference to FIGS. 6 and 7, a remarkable physical phenomenon highlighted within the scope of developments resulting in the present invention and involved in the synchronisation method implemented in the timepiece according to the invention. Understanding this phenomenon will make it possible to better understand the synchronisation obtained by the synchronisation device regulating the running of the mechanical movement.

Figure 6:
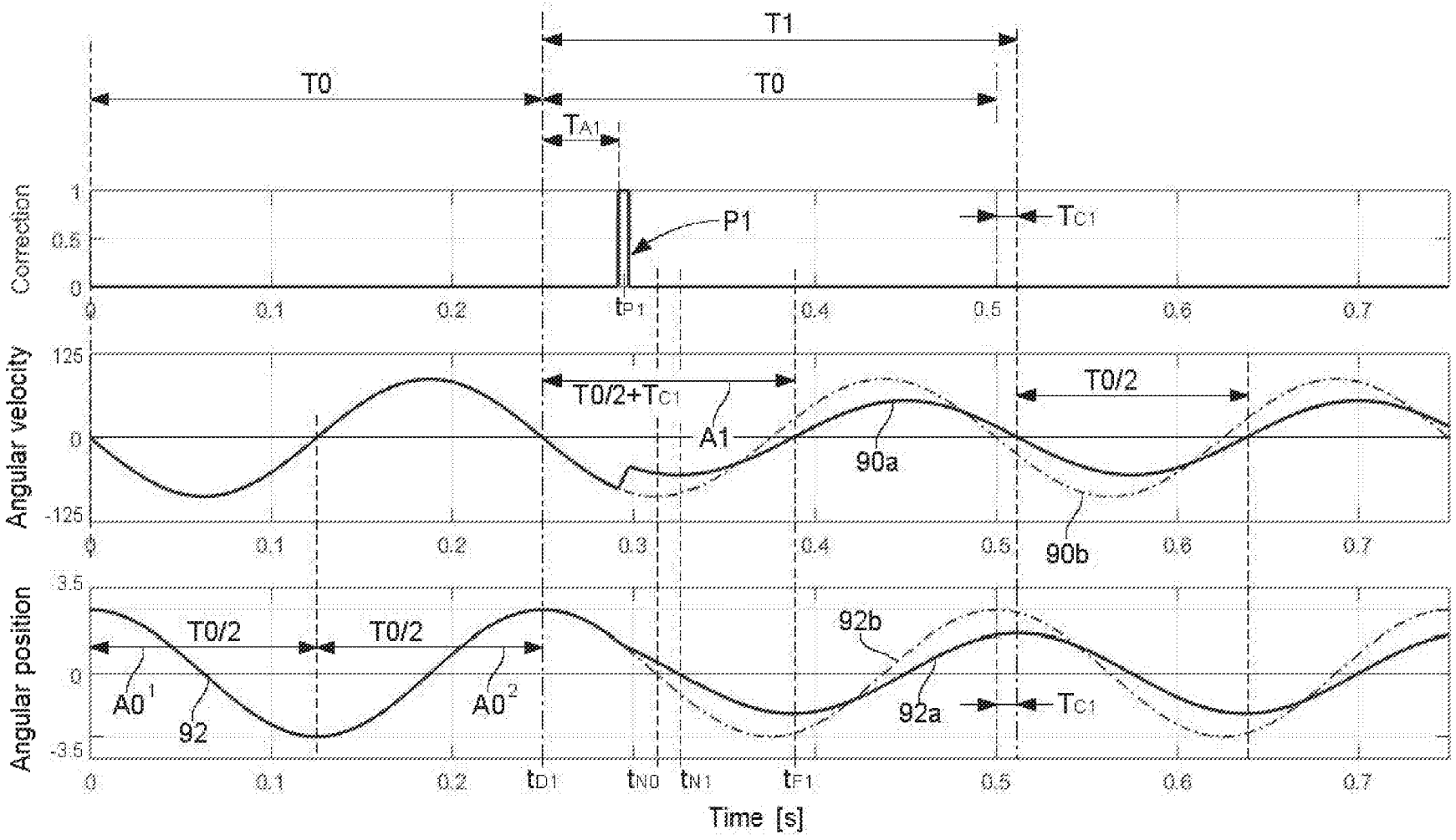
FIG. 6 shows the application of a first braking pulse to a mechanical resonator in a certain alternation of the oscillation thereof before its passes via the neutral position thereof, as well as the angular velocity of the balance and the angular position thereof in a time interval wherein the first braking pulse occurs.
Figure 7:
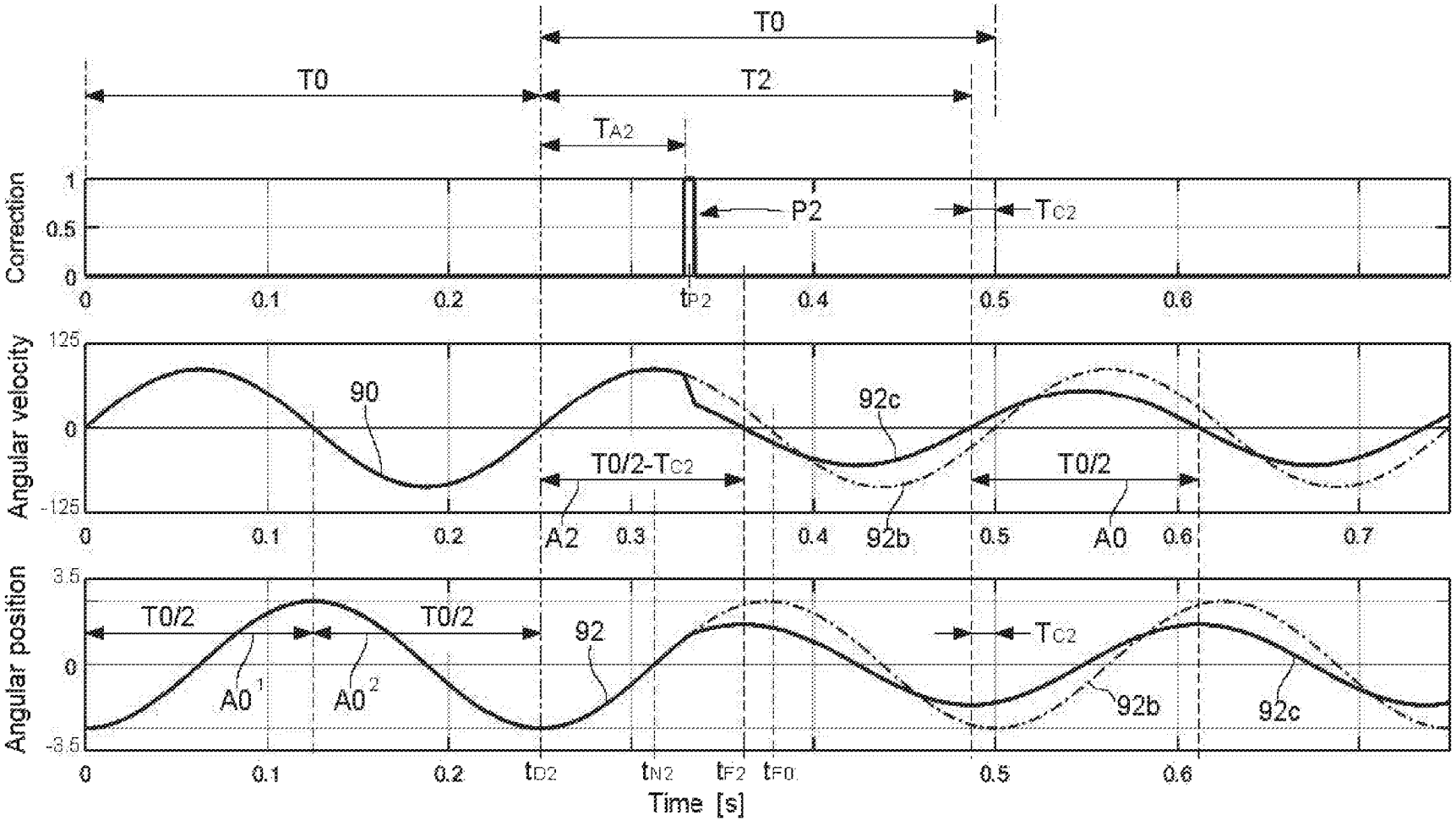
FIG. 7 is a figure similar to that in FIG. 6 but for the application of a second braking pulse in a certain alternation of the oscillation of a mechanical oscillator after it has passed via the neutral position thereof.

In FIGS. 6 and 7, the first graph shows the time $t_{P1}$ at which a braking pulse P1, respectively P2 is applied to the mechanical resonator in question to make a correction in the running of the mechanism timed by the mechanical oscillator formed by this resonator. The latter two graphs show respectively the angular velocity (values in radian per second: [rad/s]) and the angular position (values in radian: [rad]) of the oscillating member (hereinafter also 'the balance') of the mechanical resonator over time. The curves 90 and 92 correspond respectively to the angular velocity and to the angular position of the balance oscillating freely (oscillation at the natural frequency thereof) before the occurrence of a braking pulse. After the braking pulse are represented the velocity curves 90*a* and 90*b* corresponding to the behaviour of the resonator respectively in the scenario disturbed by the braking pulse and the non-disturbed scenario. Similarly, the position curves 92*a* and 92*b* correspond to the behaviour of the resonator respectively in the scenario disturbed by the braking pulse and the non-disturbed scenario. In the figures, the times $t_{P1}$ and $t_{P2}$ at which the braking pulses P1 and P2 occur correspond to the time positions of the midpoint of these pulses. However, the start of the braking pulses and the duration thereof are considered as the two parameters defining a braking pulse in terms of time.

The term braking pulse denotes the momentary application of a force couple to the mechanical resonator which brakes the oscillating member thereof (balance), i.e. which opposes the oscillation movement of this oscillating member. In the case of couple different to zero which is variable, the duration of the pulse is defined generally as the part of this pulse which has a significant force couple to brake the mechanical resonator. It should be noted that a braking pulse may exhibit a significant variation. It may even be choppy and form a succession of shorter pulses.

Each free oscillation period T0 of the mechanical oscillator defines a first alternation $A0^1$ followed by a second alternation $A0^2$ each occurring between two end positions defining the oscillation amplitude of this mechanical oscillator, each alternation having an identical duration T0/2 and exhibiting a passage of the mechanical resonator via the zero position thereof at a median time. The two successive alternations of an oscillation define two half-periods during which the balance respectively sustains an oscillation movement in one direction and subsequently an oscillation movement in the other direction. In other words, an alternation corresponds to an oscillation of the balance in one direction or the other between the two end positions thereof defining the oscillation amplitude. As a general rule, a variation in the oscillation period during which the braking pulse occurs and therefore an isolated variation of the frequency of the mechanical oscillator are observed. In fact, the time variation relates to the sole alternation during which the braking pulse occurs. The term 'median time' denotes a time occurring substantially at the midpoint of the alternations. This is specifically the case when the mechanical oscillator oscillates freely. On the other hand, for the alternations during which regulation pulses occur, this median time no longer corresponds exactly to the midpoint of the duration of each of these alternations due to the disturbance of the mechanical oscillator induced by the regulation device.

The behaviour of the mechanical oscillator in a first correction scenario of the oscillation frequency thereof, which corresponds to that shown in FIG. 6, will now be described. After a first period T0 then commences a new period T2, respectively a new alternation A1 during which a braking pulse P1 occurs. At the initial time $t_{D1}$ starts the alternation A1, the resonator 14 occupying a maximum positive angular position corresponding to an end position. Then the braking pulse P1 occurs at the time $t_{P1}$ which is situated before the median time $t_{N1}$ at which the resonator passes via the neutral position thereof and therefore also before the corresponding median time $t_{N0}$ of the non-disturbed oscillation. Finally, the alternation A1 ends at the end time $t_{F1}$. The braking pulse is triggered after a time interval $T_{A1}$ following the time $t_{D1}$ marking the start of the alternation A1. The duration $T_{A1}$ is less than a half-alternation T0/4 less the duration of the braking pulse P1. In the example given, the duration of this braking pulse is considerably less than a half-alternation T0/4.

In this first case, the braking pulse is therefore generated between the start of an alternation and the passage of the resonator via the neutral position thereof in this alternation. The angular velocity in absolute values decreases during the braking pulse P1. This induces a negative time phase shift $T_{C1}$ in the oscillation of the resonator, as shown in FIG. 6 by the two curves 90*a* and 90*b* of the angular velocity and also the two curves 92*a* and 92*b* of the angular position, i.e. a delay relative to the non-disturbed theoretical signal (shown with broken lines). Thus, the duration of the alternation A1 is increased by a time interval $T_{C1}$. The oscillation period T1, comprising the alternation A1, is therefore extended relative to the value T0. This induces an isolated decrease in the frequency of the mechanical oscillator and a momentary slowing-down of the associated mechanism, the running whereof is timed by this mechanical oscillator.

With reference to FIG. 7, the behaviour of the mechanical oscillator in a second correction scenario of the oscillation frequency thereof will be described hereinafter. After a first period T0 then commences a new oscillation period T2, respectively an alternation A2 during which a braking pulse P2 occurs. At the initial time $t_{D2}$ starts the alternation A2, the mechanical resonator then being in an end position (maximum negative angular position). After a quarter-period (T0/4) corresponding to a half-alternation, the resonator reaches the neutral position thereof at the median time $t_{N2}$. Then the braking pulse P2 occurs at the time $t_{P2}$ which is situated in the alternation A2 after the median time $t_{N2}$ at which the resonator passes via the neutral position thereof. Finally, after the braking pulse P2, this alternation A2 ends at the end time $t_{F2}$ at which the resonator once again occupies an end position (maximum positive angular position in the period T2) and therefore also before the corresponding end time $t_{F0}$ of the non-disturbed oscillation. The braking pulse is triggered after a time interval $T_{A2}$ following the initial time $t_{D2}$ of the alternation A2. The duration $T_{A2}$ is greater than a half-alternation T0/4 and less than an alternation T0/2 less the duration of the braking pulse P2. In the example given, the duration of this braking pulse is considerably less than a half-alternation.

In the second scenario in question, the braking pulse is therefore generated, in an alternation, between the median time at which the resonator passes via the neutral position thereof (zero position) and the end time at which this alternation ends. The angular velocity in absolute values decreases during the braking pulse P2. Remarkably, the braking pulse induces herein a positive time phase shift $T_{C2}$ in the oscillation of the resonator, as shown in FIG. 4 by the two curves 90*b* and 90*c* of the angular velocity and also the two curves 92*b* and 92*c* of the angular position, i.e. an advance relative to the non-disturbed theoretical signal (shown with broken lines). Thus, the duration of the alternation A2 is decreased by a time interval $T_{C2}$. The oscillation period T2, comprising the alternation A2, is therefore shorter than the value T0. This induces an isolated increase in the frequency of the mechanical oscillator and a momentary acceleration of the associated mechanism, the running whereof is timed by this mechanical oscillator. This phenomenon is surprising and not obvious, which is the reason why those skilled in the art have ignored it in the past. Indeed, obtaining an acceleration of the mechanism by a braking pulse is in principle surprising, but this is indeed the case when this running is timed by a mechanical oscillator and the braking pulse is applied to the resonator thereof.

The physical phenomenon mentioned above for mechanical oscillators is involved in the synchronisation method implemented in a timepiece according to the invention. Unlike the general teaching in the field of timepieces, it is possible not only to reduce the frequency of a mechanical oscillator with braking pulses, but it is also possible to increase the frequency of such a mechanical oscillator also with braking pulses. Those skilled in the art would expect to be able to practically only reduce the frequency of a mechanical oscillator with braking pulses and, by way of corollary, to be able to only increase the frequency of such a mechanical oscillator by applying drive pulses when supplying power to said oscillator. Such an intuitive idea, which has become established in the field of timepieces and therefore comes first to the mind of those skilled in the art, proves to be incorrect for a mechanical oscillator. Thus, as described in detail hereinafter, it is possible to synchronise, via an auxiliary oscillator defining a master oscillator, a mechanical oscillator that is very precise moreover, whether it momentarily has a frequency that is slightly too high or too low. It is therefore possible to correct a frequency that is too high or a frequency that is too low merely by means of braking pulses. In sum, applying a braking couple during an alternation of the oscillation of a balance-hairspring induces a negative or positive phase shift in the oscillation of this balance-hairspring according to whether said braking torque is applied respectively before or after the passage of the balance-hairspring via the neutral position thereof.

Figures 8A, 8B, 8C:
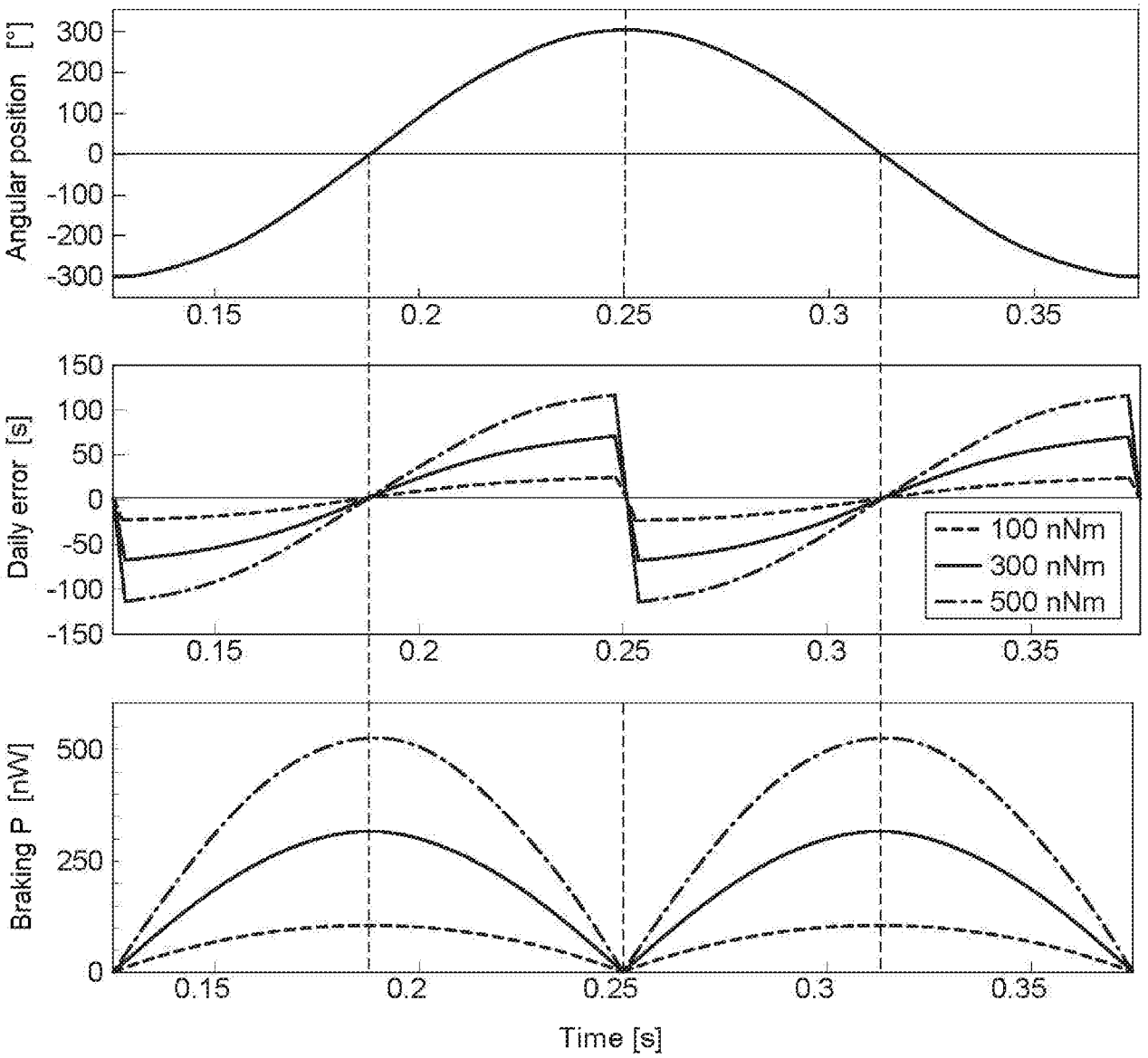
FIGS. 8A, 8B and 8C show respectively the angular position of a balance-hairspring during an oscillation period, the variation of the running of the timepiece movement obtained for a braking pulse of fixed duration, for three values of a constant braking torque, according to the angular position of the balance-hairspring, and the corresponding braking power.

The resulting synchronisation method of the correction device incorporated in a timepiece according to the invention is described hereinafter. In FIG. 8A is shown the angular position (in degrees) of a timepiece mechanical resonator oscillating with an amplitude of 300° during an oscillation period of 250 ms. In FIG. 8B is shown the daily error generated by braking pulses of one millisecond (1 ms) applied in successive oscillation periods of the mechanical resonator according to the time of the application thereof within these periods and therefore according to the angular position of the mechanical resonator. Herein is based on the fact that the mechanical oscillator functions freely at a natural frequency of 4 Hz (non-disturbed scenario). Three curves are given respectively for three force couples (100 nNm, 300 nNm and 500 nNm) applied by each braking pulse. The result confirms the physical phenomenon described above, namely that a braking pulse occurring in the first quarter-period or the third quarter-period induces a delay stemming from a decrease in the frequency of the mechanical oscillator, whereas a braking pulse occurring in the second quarter-period or the fourth quarter-period induces an advance stemming from an increase in the frequency of the mechanical oscillator. Then, it is observed that, for a given force couple, the daily error is equal to zero for a braking pulse occurring at the neutral position of the resonator, this daily error increasing (in absolute values) on approaching an end position of the oscillation. At this end position where the velocity of the resonator passes via zero and where the direction of the movement changes, there is a sudden inversion of the sign of the daily error. Finally, in FIG. 8C is given the braking power consumed for the three force couple values mentioned above as a function of the time of application of the braking pulse during an oscillation period. As the velocity decreases on approaching the end positions of the resonator, the braking power decreases. Thus, while the daily error induced increases on approaching the end positions, the braking power required (and therefore the energy lost by the oscillator) decreases significantly.

The error induced in FIG. 8B may correspond in fact to a correction for the scenario where the mechanical oscillator has a natural frequency which does not correspond to a set-point frequency. Thus, if the oscillator has a natural frequency that is too low, braking pulses occurring in the second or fourth quarter of the oscillation period may enable a correction of the delay adopted by the free (non-disturbed) oscillation, this correction being more or less substantial according to the time of the braking pulses within the oscillation period. On the other hand, if the oscillator has a natural frequency that is too high, braking pulses occurring in the first or third quarter of the oscillation period may enable a correction of the advance adopted by the free oscillation, this correction being more or less substantial according to the time of the braking pulses within the oscillation period.

The teaching given above makes it possible to understand the remarkable phenomenon of the synchronisation of a main mechanical oscillator (slave oscillator) on an auxiliary oscillator, forming a master oscillator, by the mere periodic application of braking pulses on the slave mechanical resonator at a braking frequency $F_{FR}$ corresponding advantageously to double the set-point frequency $F0_C$ divided by a positive whole number N, i.e. $F_{FR}=2\cdot F0_C/N$. The braking frequency is thus proportional to the set-point frequency for the master oscillator and merely dependent on this set-point frequency once the positive whole number N is given. As the set-point frequency is envisaged to be equal to a fractional number multiplied by the reference frequency, the braking frequency is therefore proportional to the reference frequency and determined by this reference frequency, which is supplied by the auxiliary oscillator which is by nature or by design more precise than the main mechanical oscillator.

The synchronisation mentioned above obtained by the correction device incorporated in the timepiece according to the invention will now be described in more detail with the aid of FIGS. 9 to 22.

Figure 9:
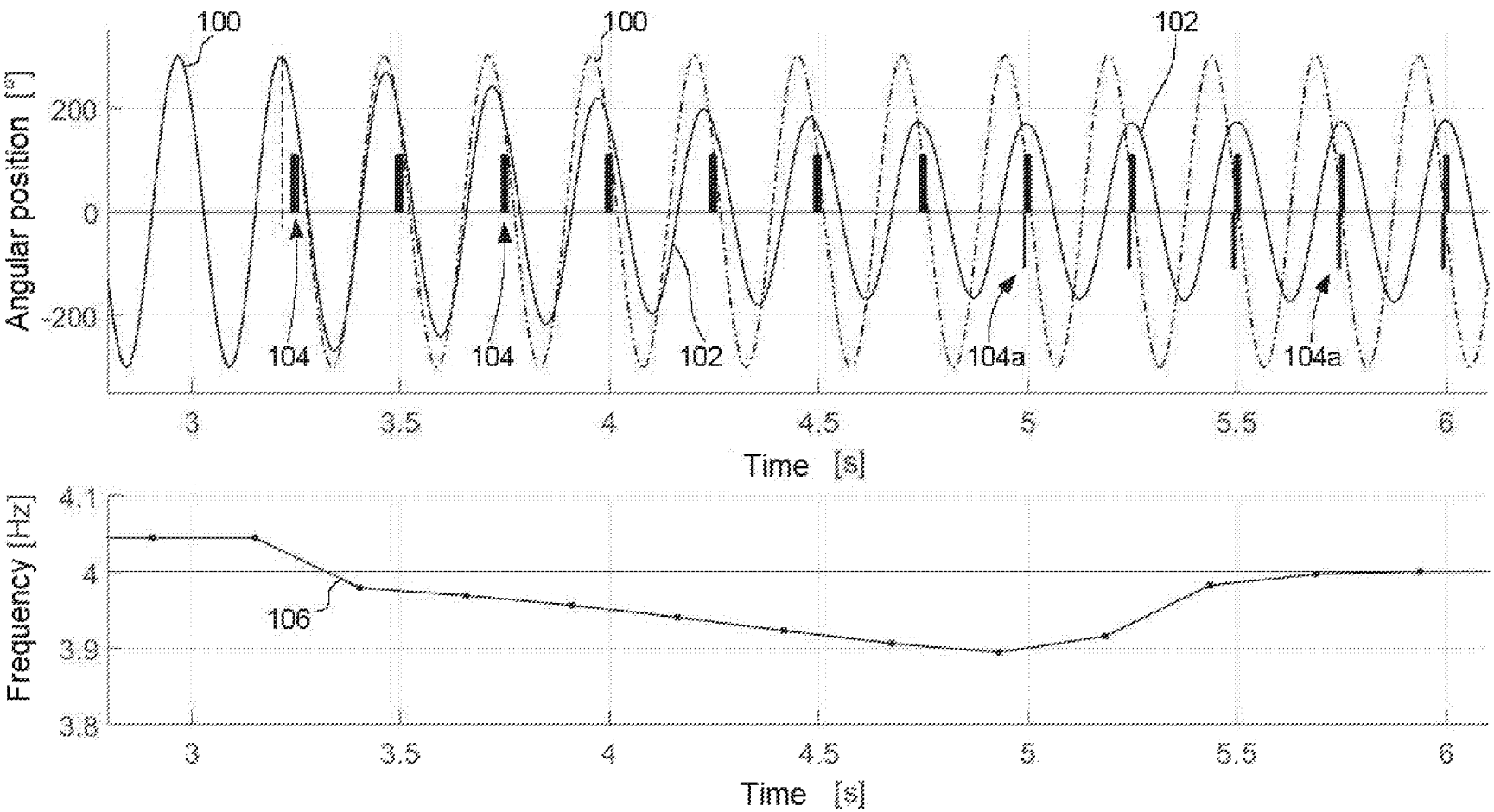
FIGS. 9, 10 and 11 show respectively three different scenarios liable to arise in an initial phase following the interlocking of the correction device in a timepiece according to the invention.

In FIG. 9 is represented on the top graph the angular position of the slave mechanical resonator, particularly of the balance-hairspring of a timepiece resonator, oscillating freely (curve 100) and oscillating with braking (curve 102). The frequency of the free oscillation is greater than the set-point frequency $F0_C$=4 Hz. The first braking pulses 104 (hereinafter also referred to as 'pulses') occur herein once per oscillation period in a half-alternation between the passage via an end position and the passage via zero. This choice is arbitrary as the system envisaged does not detect the angular position of the mechanical resonator; this is therefore merely a possible hypothesis among others which will be analysed hereinafter. Therefore, the scenario of a slowing-down of the mechanical oscillator is observed herein. The braking torque for the first braking pulse is envisaged herein greater than a minimum braking torque to compensate for the advance adopted by the free oscillator over an oscillation period. This results in the second braking pulse taking place slightly before the first within the quarter-period wherein these pulses occur. The curve 106, which gives the instantaneous frequency of the mechanical oscillator, indeed indicates that the instantaneous frequency falls below the set-point frequency from the first pulse. Thus, the second braking pulse is closer to the preceding end position, such that the braking effect increases and so on with the subsequent pulses. In a transitory phase, the instantaneous frequency of the oscillator decreases therefore progressively and the pulses move closer progressively to an end position of the oscillation. After a certain time, the braking pulses comprise the passage via the end position where the velocity of the mechanical resonator changes direction and the instantaneous frequency then starts to increase.

The braking is characterised in that it opposes the movement of the resonator regardless of the direction of the movement thereof. Thus, when the resonator passes via an inversion of the direction of the oscillation thereof during a braking pulse, the braking torque automatically changes sign at the time of this inversion. This gives braking pulses 104*a* which have, for the braking torque, a first part with a first sign and a second part with a second sign opposite the first sign. In this scenario, the first part of the signal therefore occurs before the end position and opposes the effect of the second part which occurs after this end position. While the second part reduces the instantaneous frequency of the mechanical oscillator, the first part increases same. The correction then decreases to stabilise eventually and relatively quickly at a value for which the instantaneous frequency of the oscillator is equal to the set-point frequency (corresponding herein to the braking frequency). Thus, the transitory phase is succeeded by a stable phase, also referred to as synchronous phase, where the oscillation frequency is substantially equal to the set-point frequency and where the first and second parts of the braking pulses have a substantially constant and defined ratio.

Figure 10:
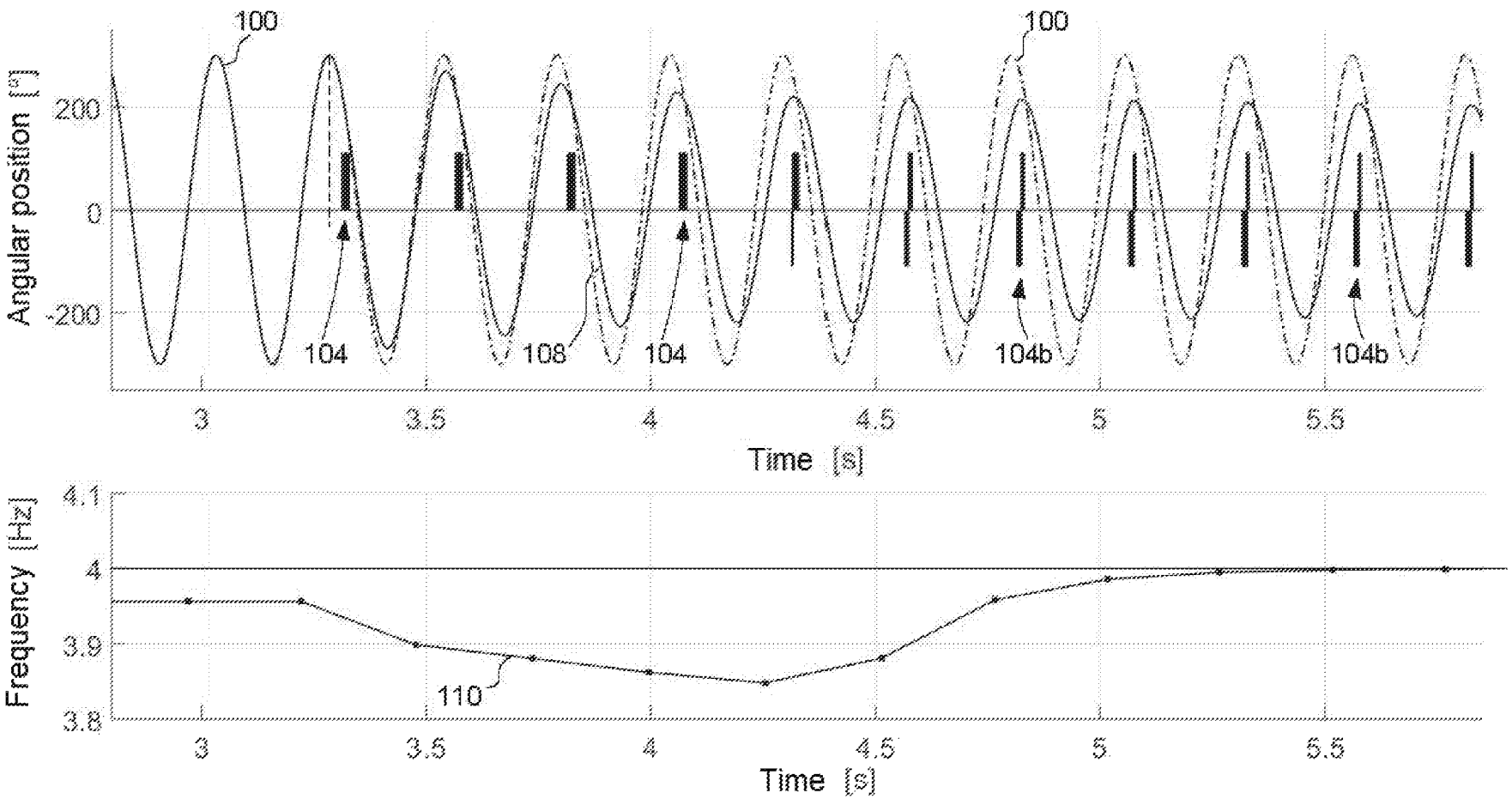

The graphs in FIG. 10 are equivalent to those in FIG. 9. The major difference is the value of the natural frequency of the free mechanical oscillator which is less than the set-point frequency $F0_C$=4 Hz. The first pulses 104 occur in the same half-alternation as in FIG. 9. As expected, a decrease in the instantaneous frequency given by the curve 110 is observed. The oscillation with braking 108 therefore adopts momentarily more delay in the transitory phase, until the pulses 104*b* start to encompass the passage of the resonator via an end position. From this time, the instantaneous frequency starts to increase until it reaches the set-point frequency, as the first part of the pulses occurring before the end position increases the instantaneous frequency. This phenomenon is automatic. Indeed, while the duration of the oscillation periods is greater than the duration of the $T0_C$, the first part of the pulse increases while the second part decreases and consequently the instantaneous frequency continues to increase to a stable status where the set-point period is substantially equal to the oscillation period. Therefore, the desired synchronisation is obtained.

Figure 11:
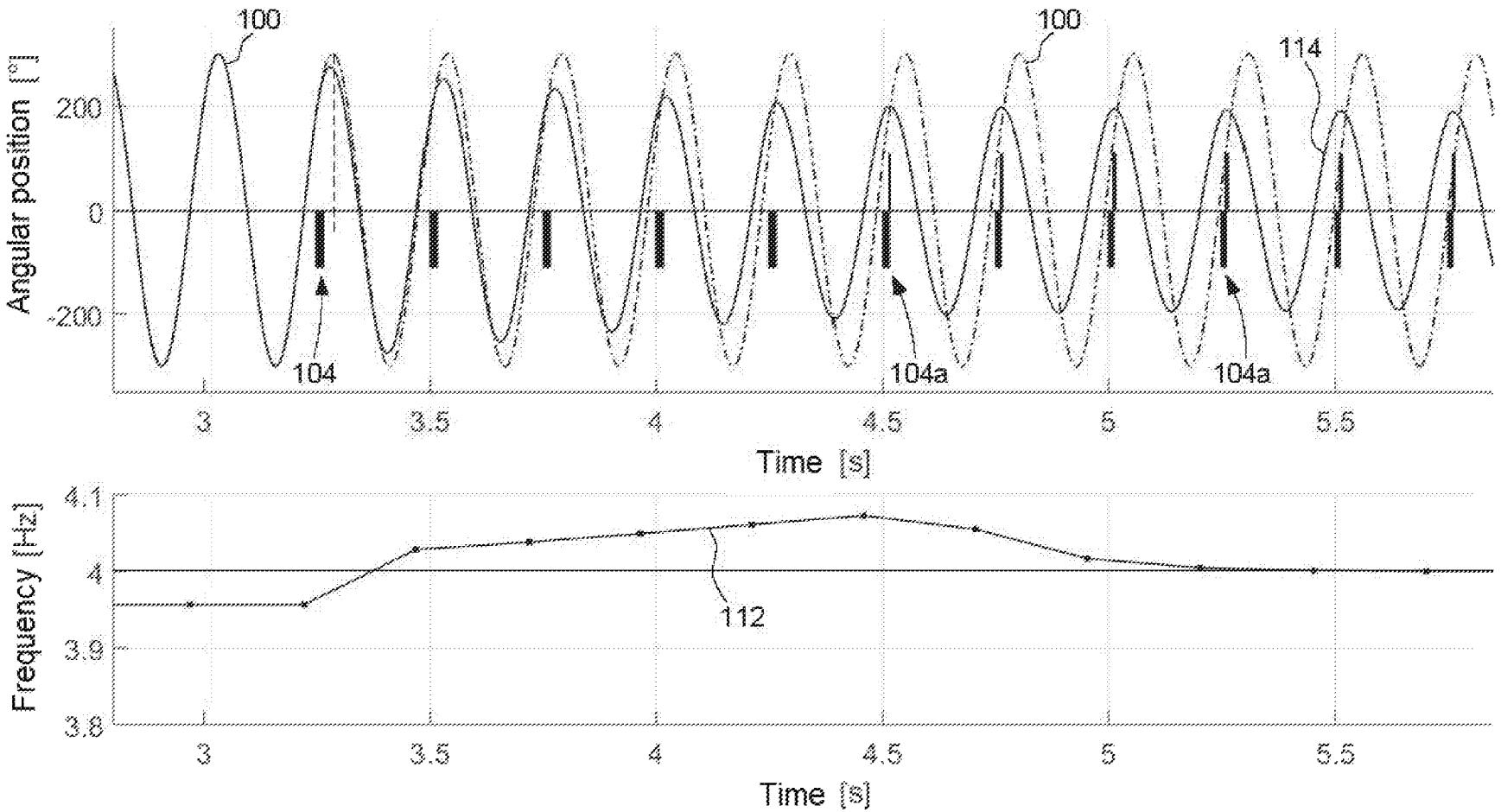

The graphs in FIG. 11 are equivalent to those in FIG. 10. The major difference is in that the first braking pulses 114 occur in another half-alternation than in FIG. 10, namely in a half-alternation between the passage via zero and the passage via an end position. As described above, in a transitory phase, an increase in the instantaneous frequency given by the curve 112 is observed herein. The braking torque for the first braking pulse is envisaged herein greater than a minimum braking torque to compensate for the delay adopted by the free mechanical oscillator over an oscillation period. This results in the second braking pulse taking place slightly after the first within the quarter-period wherein these pulses occur. The curves 112 shows indeed that the instantaneous frequency of the oscillator increases above the set-point frequency from the first pulse. Thus, the second braking pulse is closer to the subsequent end position, such that the braking effect increases and so on with the subsequent pulses. In the transitory phase, the instantaneous frequency of the oscillation with braking 114 increases therefore and the braking pulses move closer progressively to an end position of the oscillation. After a certain time, the braking pulses comprise the passage via the end position where the velocity of the mechanical resonator changes direction. From that time, a similar phenomenon to that described above is observed. The braking pulses 114*a* then have two parts and the second part reduces the instantaneous frequency. This decrease in the instantaneous frequency continues until it has a value equal to the set-point value for the same reasons as given with reference to FIGS. 9 and 10. The decrease in frequency stops automatically when the instantaneous frequency is substantially equal to the set-point frequency. A stabilisation of the frequency of the mechanical oscillator at the set-point frequency in a synchronous phase is then obtained.

Figure 12:
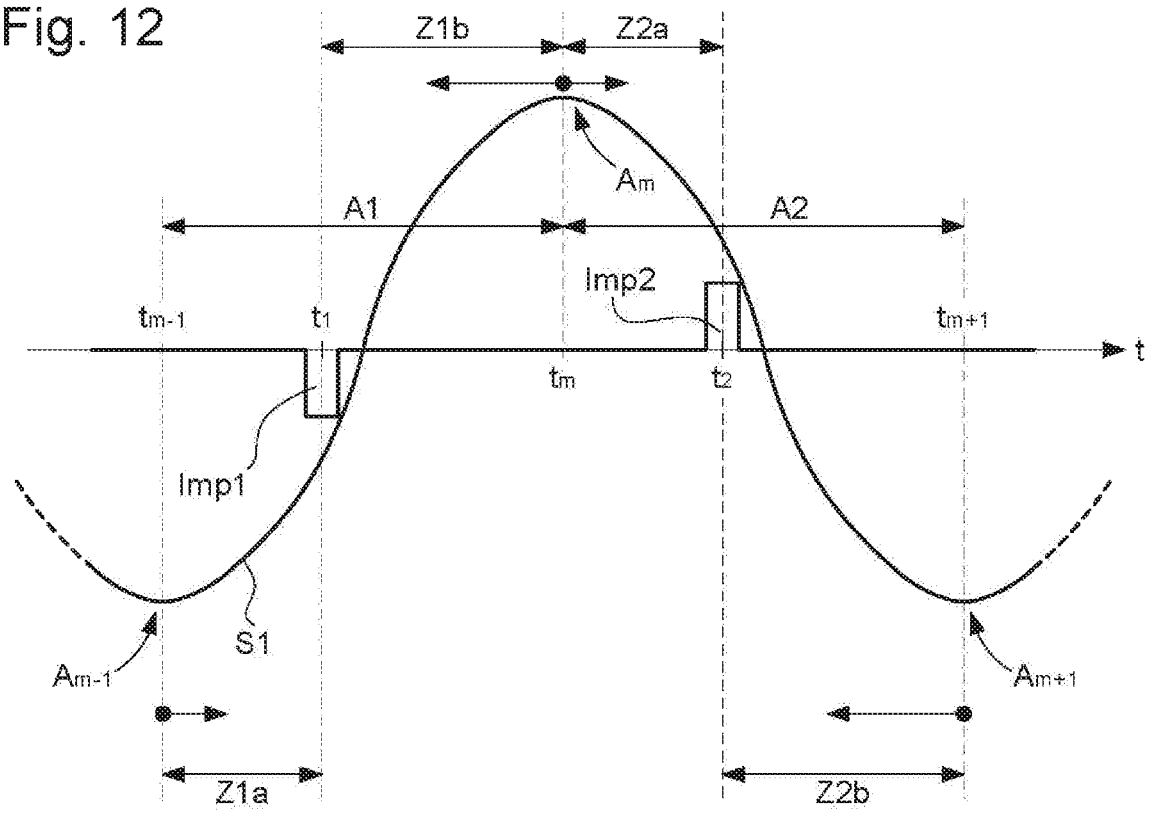
FIG. 12 is an explanatory graph of the physical process arising following the interlocking of the correction device in the timepiece according to the invention and resulting in the synchronisation sought for the scenario where the natural frequency of the slave mechanical oscillator is greater than the set-point frequency.

With the aid of FIGS. 12 to 15, the behaviour of the mechanical oscillator in the transition phase for any time where a first braking pulse occurs during an oscillation period will be described, as well as the final scenario corresponding to the synchronous phase where the oscillation frequency is stabilised on the set-point frequency. FIG. 12 represents an oscillation period with the curve S1 of the positions of a mechanical resonator. In the scenario in question herein, the natural oscillation frequency F0 of the free mechanical oscillator (with no braking pulses) is greater than the set-point frequency $F0_C$ ($F0>F0_C$). The oscillation period comprises conventionally a first alternation A1 followed by a second alternation A2, each between two end positions, ($t_{m-1}$, $A_{m-1}$; $t_m$, $A_m$; $t_{m+1}$, $A_{m+1}$) corresponding to the oscillation amplitude. Then, there is represented, in the first alternation, a braking pulse 'Imp' wherein the midpoint time position occurs at a time $t_1$ and, in the second alternation, a further braking pulse 'Imp2' wherein the midpoint time position occurs at a time $t_2$. The pulses Imp1 and Imp2 exhibit a phase shift of T0/2, and they are characterised in that they correspond, for a given braking torque profile, to corrections inducing two unstable equilibria of the system. As these pulses occur respectively in the first and the third quarter of the oscillation period, they therefore brake the mechanical oscillator to a degree which makes it possible exactly to correct the excessively high natural frequency of the free mechanical oscillator (with the braking frequency selected for the application of the braking pulses). It should be noted that the pulses Imp1 and Imp2 are both of the first pulses, each being considered on its own in the absence of the other. It should be observed that the effects of the pulses Imp1 and Imp2 are identical.

If a first pulse occurs at the time $t_1$ or $t_2$, there will therefore be theoretically a repetition of this scenario during the next oscillation periods and an oscillation frequency equal to the set-point frequency. Two things should be noted for such a scenario. Firstly, the probability of a first pulse occurring exactly at the time $t_1$ or $t_2$ is relatively low though possible. Secondly, should such a particular scenario arise, it would not be able to last for a long time. Indeed, the instantaneous frequency of a balance-hairspring in a timepiece varies slightly over time for various reasons (oscillation amplitude, temperature, change of spatial orientation, etc.). Although these reasons represent disturbances that it is generally sought to minimise in fine watchmaking, the fact remains that, in practice, such an unstable equilibrium will not last very long. It should be noted that the higher the braking torque, the closer the times $t_1$ and $t_2$ are to the two passage times of the mechanical resonator via the neutral position thereof following same respectively. It should be noted further that the greater the difference between the natural oscillation frequency F0 and the set-point frequency $F0_C$, the closer the times $t_1$ and $t_2$ are also to the two passage times of the mechanical resonator via the neutral position thereof following same respectively.

Let us now consider what happens when deviating slightly from the time positions $t_1$ or $t_2$ during the application of the pulses. According to the teaching given with reference to FIG. 8B, if a pulse occurs to the left (prior time position) of the pulse Imp1 in the zone Z1a, the correction increases such that during subsequent periods, the preceding end position $A_{m-1}$ will progressively approach the braking pulse. On the other hand, if a pulse occurs to the right (subsequent time position) of the pulse Imp1, to the left of the zero position, the correction decreases such that during the subsequent periods the pulses drift towards this zero position where the correction becomes nil. Indeed, the effect of the pulse changes and an increase in the instantaneous frequency occurs. As the natural frequency is already too high, the pulse will rapidly drift to the end position $A_m$. Thus, if a pulse takes place to the right of the pulse Imp1 in the zone Z1b, the subsequent pulses will progressively approach the subsequent end position $A_m$. The same behaviour is observed in the second alternation A2. If a pulse takes place to the left of the pulse Imp2 in the zone Z2a, the subsequent pulses will progressively approach the preceding end position $A_m$. On the other hand, if a pulse takes place to the right of the pulse Imp2 in the zone Z2b, the subsequent pulses will progressively approach the subsequent end position $A_{m+1}$. It should be noted that this formulation is relative as in fact the application frequency of the braking pulses is set by the master oscillator (given braking frequency), such that it is the oscillation periods that vary and hence it is the end position in question that approaches the application time of a braking pulse. In conclusion, if a pulse occurs in the first alternation A1 at a time other than $t_1$, the instantaneous oscillation frequency progresses in a transitory phase during the subsequent oscillation periods such that one of the two end positions of this first alternation (positions of inversion of the direction of movement of the mechanical resonator) progressively approaches the braking pulses. The same applies for the second alternation A2.

Figure 13:
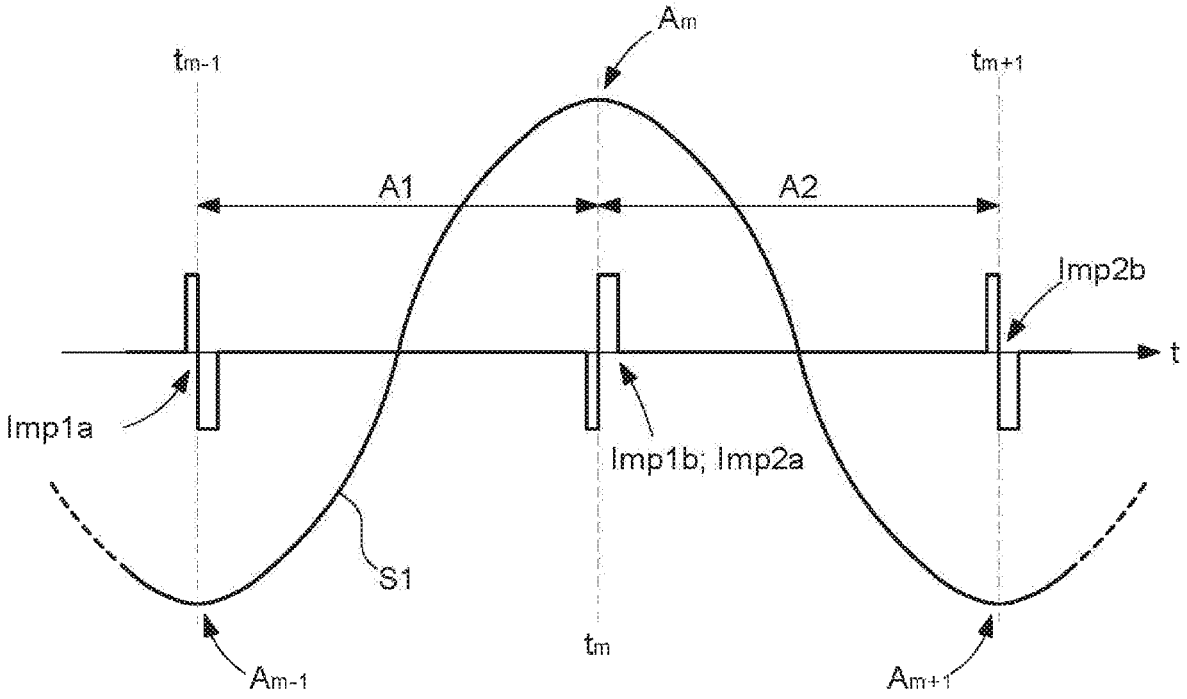
FIG. 13 represents, in the scenario of FIG. 12, an oscillation of the slave mechanical oscillator and the braking pulses in a stable synchronous phase for an alternative embodiment where a braking pulse occurs in each alternation.

FIG. 13 shows the synchronous phase corresponding to a final stable status occurring after the transitory phase described above. As previously explained, once the passage via an end position occurs during a braking pulse, this end position will be aligned on the braking pulses for all that these braking pulses are configured (the force couple and the duration) to be able to correct the time drift of the free mechanical oscillator sufficiently at least with a braking pulse occurring entirely, depending on the case, just before or just after an end position. Thus, in the synchronous phase, if a first pulse occurs in the first alternation A1, either the end position $A_{m-1}$ of the oscillation is aligned on the pulses Imp1a, or the end position $A_m$ of the oscillation is aligned on the pulses Imp1b. In the case of a substantially constant couple, the pulses Imp1a and Imp1b each have a first part wherein the duration is shorter than that of the second part thereof, so as to correct exactly the difference between the natural frequency that is too high of the slave main oscillator and the set-point frequency set by the master auxiliary oscillator. Similarly, in the synchronous phase, if a first pulse occurs in the second alternation A2, either the end position $A_m$ of the oscillation is aligned on the pulses Imp2a, or the end position $A_{m+1}$ of the oscillation is aligned on the pulses Imp2b.

It should be noted that the pulses Imp1a, respectively Imp1b, Imp2a and Imp2b occupy relatively stable time positions. Indeed, a slight deviation to the left or to the right of one of these pulses, due to an external disturbance, will have the effect of returning a subsequent pulse to the initial relative time position. Then, if the time drift of the mechanical oscillator varies during the synchronous phase, the oscillation will automatically sustain a slight phase shift such that the ratio between the first part and the second part of the pulses Imp1a, respectively Imp1b, Imp2a and Imp2b varies to a degree which adapts the correction induced by the braking pulses to the new difference in frequency. Such behaviour of the timepiece according to the present invention is truly remarkable.

Figure 14:
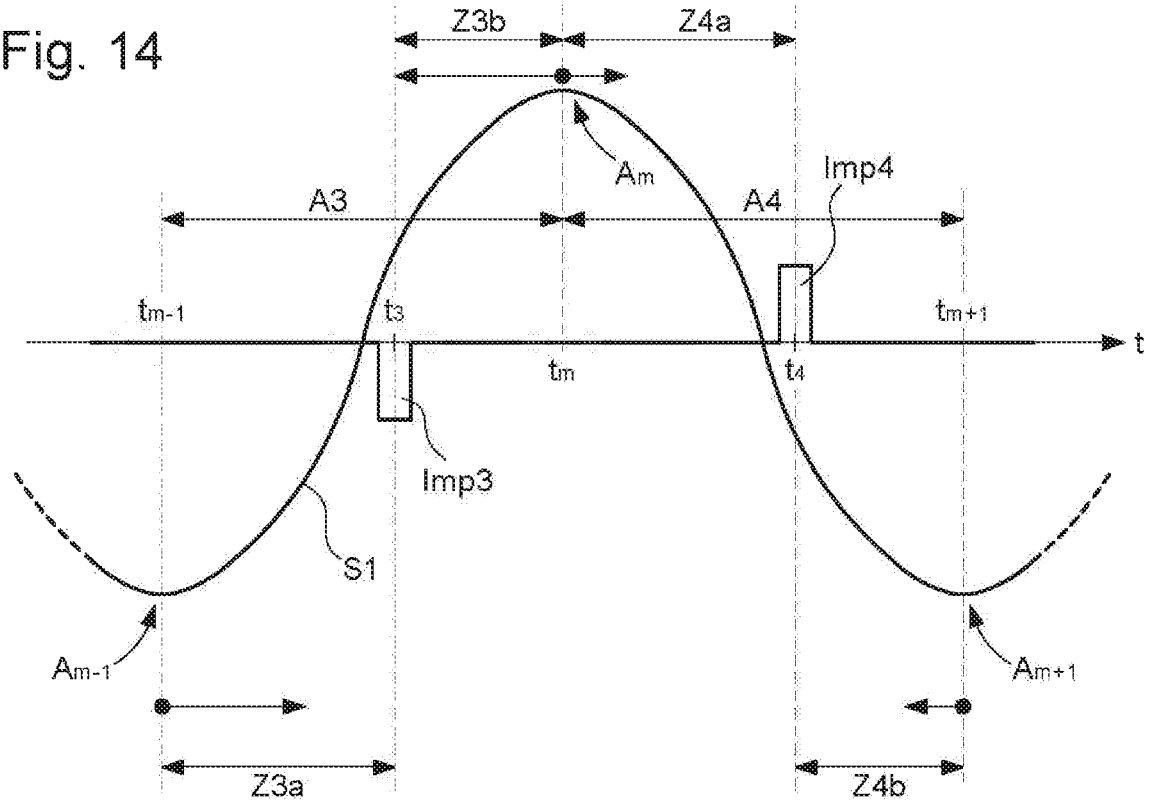
FIG. 14 is an explanatory graph of the physical process arising following the interlocking of the correction device in the timepiece according to the invention and resulting in the synchronisation sought for the scenario where the natural frequency of the slave mechanical oscillator is less than the set-point frequency.
Figure 15:
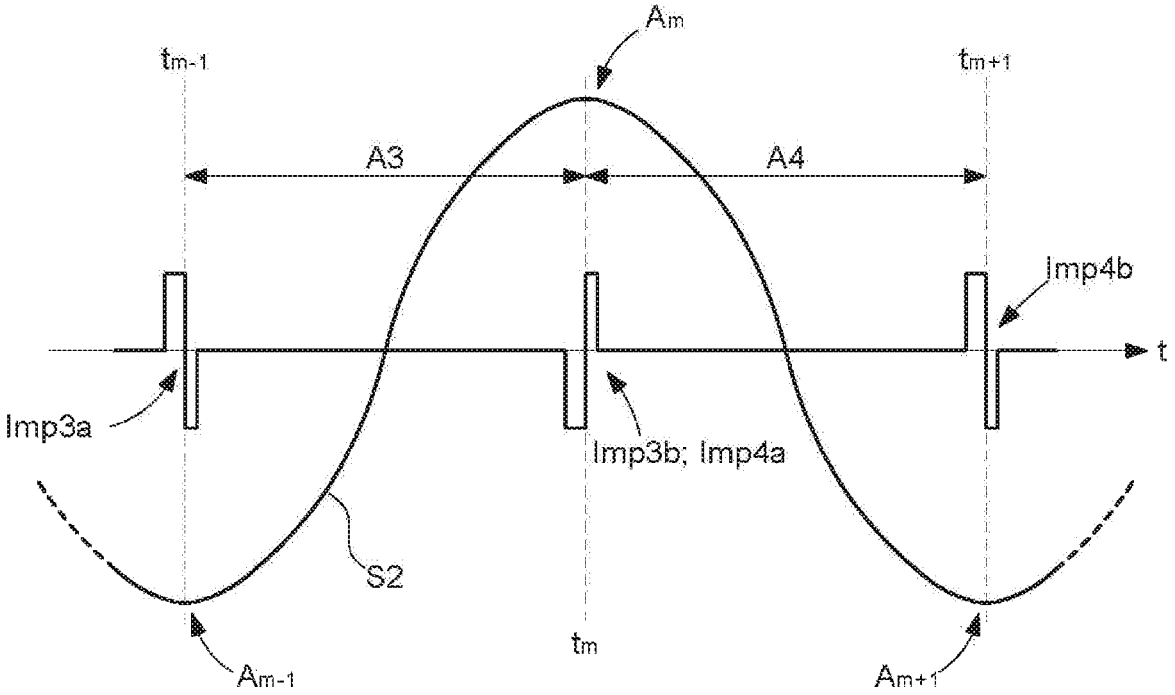
FIG. 15 represents, in the scenario of FIG. 14, an oscillation of the slave mechanical oscillator and the braking pulses in a stable synchronous phase for an alternative embodiment where a braking pulse occurs in each alternation, FIGS. 16 and 17 provide, respectively for the two scenarios of FIGS. 12 and 14, the graph of the angular position of a mechanical oscillator and the corresponding oscillation periods for an operating mode of the correction device where a braking pulse occurs every four oscillation periods.

FIGS. 14 and 15 are similar to FIGS. 12 and 13, but for a scenario where the natural frequency of the oscillator is less than the set-point frequency. Consequently, the pulses Imp3 and Imp4, corresponding to an unstable equilibrium scenario in the correction made by the braking pulses, are respectively situated in the second and the fourth quarter-period (times $t_3$ and $t_4$) where the pulses induce an increase in the oscillation frequency. The explanations will be given in detail again herein as the behaviour of the system stems from the preceding considerations. In the transitory phase (FIG. 14), if a pulse takes place in the alternation A3 to the left of the pulse Imp3 in the zone Z3a, the preceding end position ($t_{m-1}$, $A_{m-1}$) will progressively approach the subsequent pulses. On the other hand, if a pulse takes place to the right of the pulse Imp3 in the zone Z3b, the subsequent end position ($t_m$, $A_m$) will progressively approach the subsequent pulses. Similarly, if a pulse takes place in the alternation A4 to the left of the pulse Imp4 in the zone Z4a, the preceding end position ($t_m$, $A_m$) will progressively approach the subsequent pulses. Finally, if a pulse takes place to the right of the pulse Imp4 in the zone Z4b, the subsequent end position ($t_{m+1}$, $A_{m+1}$) will progressively approach the subsequent pulses during the transition phase.

In the synchronous phase (FIG. 15), if a first pulse occurs in the first alternation A3, either the end position $A_{m-1}$ of the oscillation is aligned on the pulses Imp3a, or the end position $A_m$ of the oscillation is aligned on the pulses Imp3b. In the case of a substantially constant couple, the pulses Imp3a and Imp3b each have a first part wherein the duration is longer than that of the second part thereof, so as to correct exactly the difference between the natural frequency that is too low of the slave main oscillator and the set-point frequency set by the master auxiliary oscillator. Similarly, in the synchronous phase, if a first pulse occurs in the second alternation A4, either the end position $A_m$ of the oscillation is aligned on the pulses Imp4a, or the end position $A_{m+1}$ of the oscillation is aligned on the pulses Imp4b. The other considerations made within the scope of the scenario described above with reference to FIGS. 12 and 13 are applied by analogy to the scenario of FIGS. 14 and 15. In conclusion, whether the natural frequency of the free mechanical oscillator is too high or too low and regardless of the time of application of a first braking pulse within an oscillation period, the correction device according to the invention is effective and rapidly synchronises the frequency of the mechanical oscillator, timing the running of the mechanical movement, on the set-point frequency which is determined by the reference frequency of the master auxiliary oscillator, which controls the braking frequency at which the braking pulses are applied to the resonator of the mechanical oscillator. This remains true if the natural frequency of the mechanical oscillator varies and even if it is, in certain time periods, greater than the set-point frequency, while in other time periods it is less than this set-point frequency.

The teaching given above and the synchronisation obtained by means of the features of the timepiece according to the invention also apply to the scenario where the braking frequency for the application of the braking pulses is not equal to the set-point frequency. In the case of the application of one pulse per oscillation period, the pulses taking place at the unstable positions ($t_1$, Imp1; $t_2$, Imp2; $t_3$, Imp3; $t_4$, Imp4) correspond to corrections to compensate for the time drift during a single oscillation period. On the other hand, if the braking pulses envisaged have a sufficient effect to correct a time drift during a plurality of oscillation periods, it is then possible to apply a single pulse per time interval equal to the plurality of oscillation periods. The same behaviour as for the scenario where one pulse is generated per oscillation period will then be observed. Taking the oscillation periods where the pulses occur into consideration, there are the same transitory phases and the same synchronous phases as in the scenario described above. Furthermore, these considerations are also correct if there is a whole number of alternations between each braking pulse. In the case of an odd number of alternations, a transition is made alternatively, depending on the case, from the alternation A1 or A3 to the alternation A2 or A4 in FIGS. 12 to 15. As the effect of two pulses offset by an alternation is identical, it is understood that the synchronisation is carried out as for an even number of alternations between two successive braking pulses. In conclusion, as already stated, the behaviour of the system described with reference to FIGS. 12 to 15 is observed once the braking frequency $F_{FR}$ is equal to $2F0_C/N$, $F0_C$ being the set-point frequency for the oscillation frequency and N a positive whole number.

Though of little interest, it should be noted that the synchronisation is also obtained for a braking frequency $F_{FR}$ greater than double the set-point frequency (2F0), namely for a value equal to N times F0 where N>2. In an alternative embodiment where $F_{FR}$=4F0, there is merely a loss of energy in the system with no effect in the synchronous phase, as one out of every two pulses occurs at the neutral point of the mechanical resonator. For a higher braking frequency $F_{FR}$, the pulses in the synchronous phase which do not occur at the end positions cancel the effects thereof pairwise. It is therefore understood that these are theoretical scenarios with no major practical sense.

Figure 16:
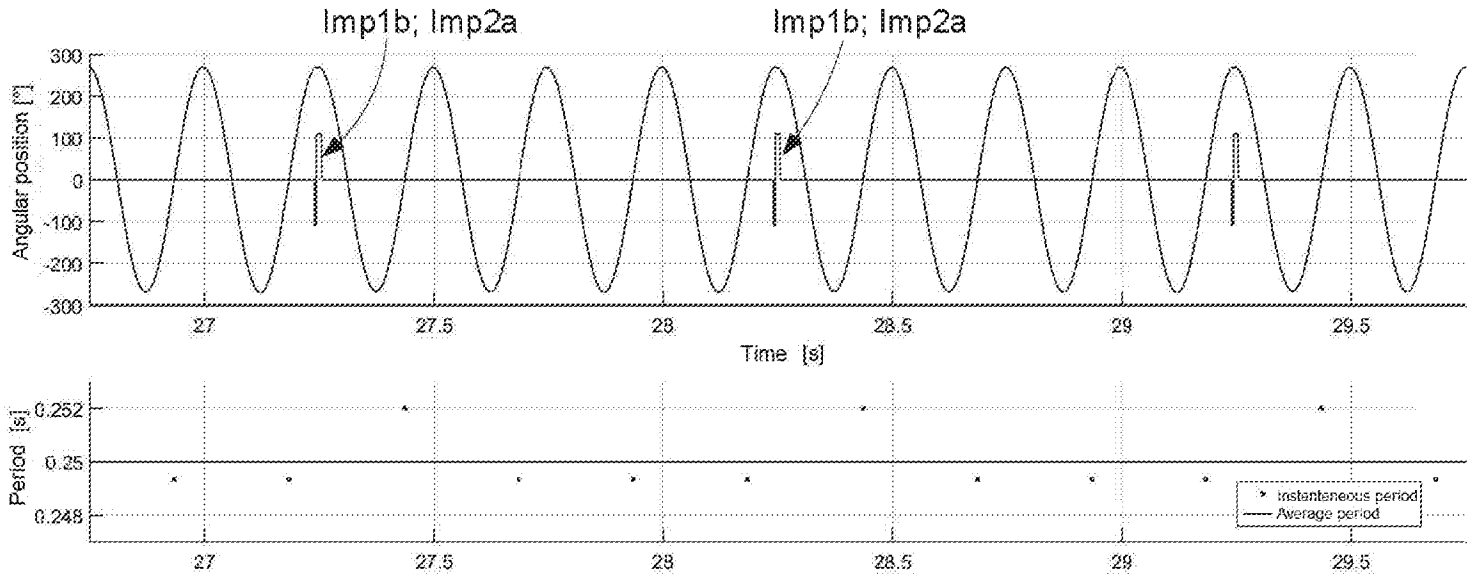
Figure 17:
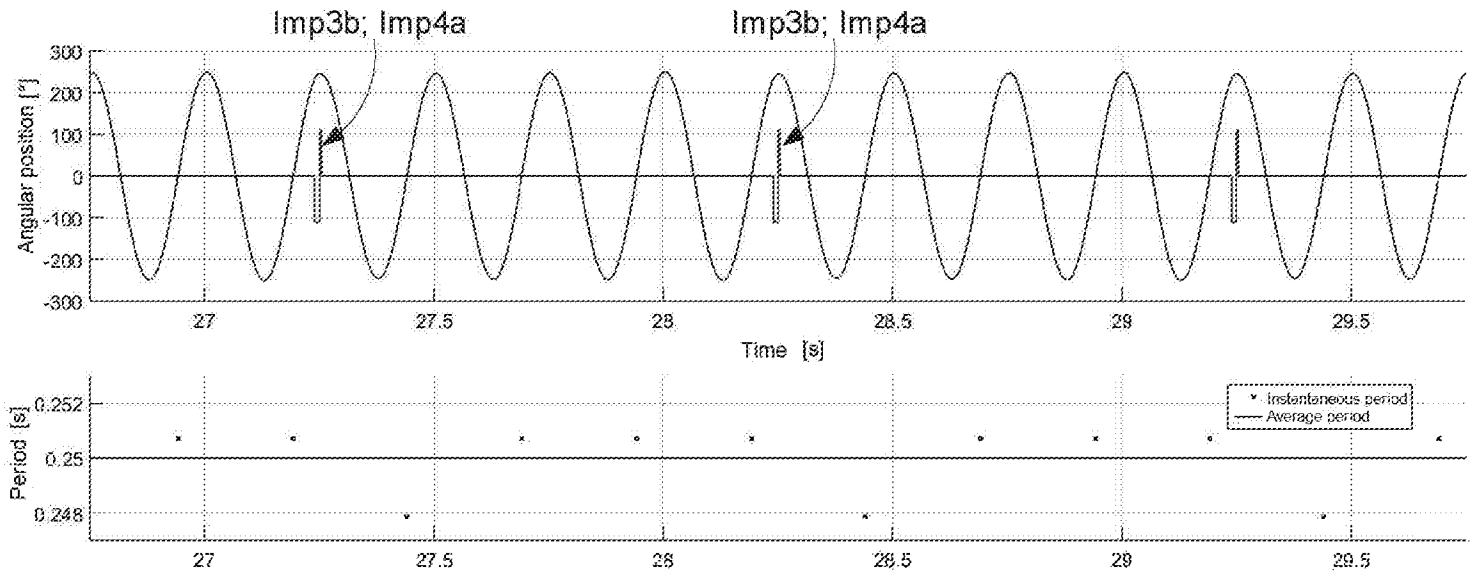
Figure 18:
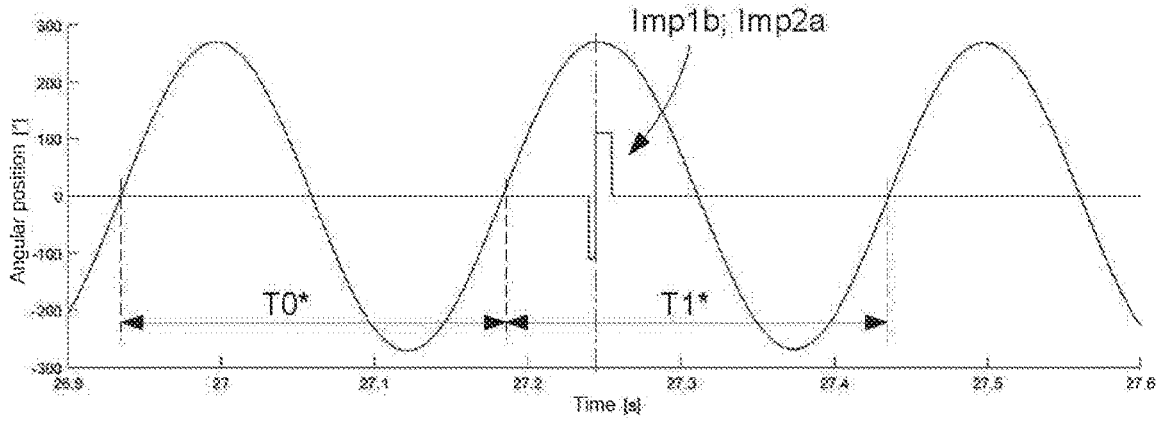
FIGS. 18 and 19 are respectively partial enlargements of FIGS. 16 and 17.
Figure 19:
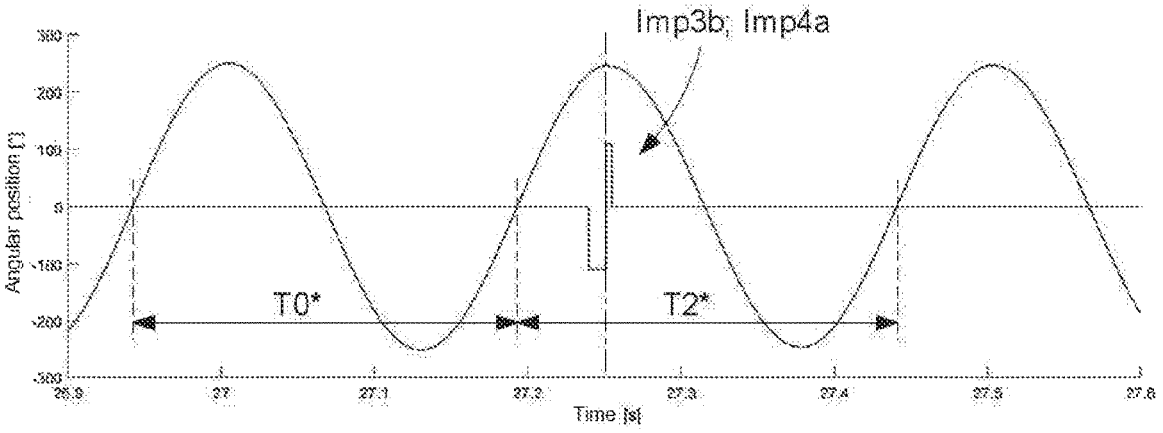

FIGS. 16 and 17 show the synchronous phase for an alternative embodiment with a braking frequency $F_{FR}$ equal to one quarter of the set-point frequency, one braking pulse occurring therefore every four oscillation periods. FIGS. 18 and 19 are partial enlargements respectively of FIGS. 16 and 17. FIG. 16 relates to a scenario where the natural frequency of the main oscillator is greater than the set-point frequency $F0_C$=4 Hz, while FIG. 17 relates to a scenario where the natural frequency of the main oscillator is greater than this set-point frequency. It is observed that only the oscillation periods T1* and T2*, wherein braking pulses Imp1b or Imp2a, respectively Imp3b or Imp4a occur, exhibit a variation relative to the natural period T0*. The braking pulses induce a phase shift merely in the corresponding periods.

Figure 20:
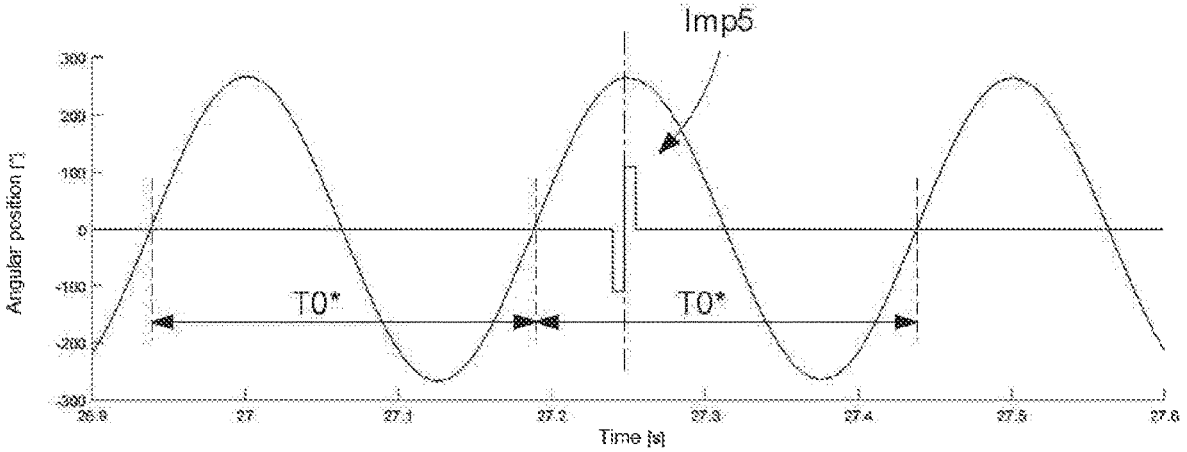
FIG. 20 represents, similarly to the two preceding figures, a specific scenario wherein the frequency of a mechanical oscillator is equal to the braking frequency.

Thus, the instantaneous periods oscillate herein about an average value which is equal to that of the set-point period. It should be noted that, in FIGS. 16 to 19, the instantaneous periods are measured from a passage via zero on a rising edge of the oscillation signal to such a subsequent passage. Thus, the synchronous pulses which occur at the end positions are entirely included in oscillation periods. In order to be comprehensive, FIG. 20 shows the specific scenario where the natural frequency is equal to the set-point frequency. In this case, the oscillation periods T0* all remain equal, the braking pulses Imp5 occurring exactly at end positions of the free oscillation with first and second parts of these pulses which have identical durations (case of a constant braking torque), such that the effect of the first part is cancelled by the opposite effect of the second part.

In an enhanced alternative embodiment, the synchronisation device is arranged such that the braking frequency may adopt a plurality of values, preferably a first value in an initial phase of the operation of the synchronisation device and a second value, less than the first value, in a normal operating phase following the initial phase. In particular, the duration of the initial phase will be selected such that the normal operating phase occurs while the synchronous phase has probably already commenced. More generally, the initial phase includes at least the first braking pulses, following the engagement of the synchronisation device, and preferably most of the transitory phase. By increasing the frequency of the braking pulses, the duration of the transitory phase is reduced. Furthermore, this alternative embodiment makes it possible, on one hand, to optimise the braking efficiency during the initial phase to carry out the physical process resulting in synchronisation and, on the other, to minimise the braking energy and therefore the energy losses for the main oscillator during the synchronous phase that remains while the synchronisation device has not been deactivated and the mechanical movement is operating. The first braking pulses may occur in the vicinity of the neutral position of the resonator where the braking effect is lesser on the time phase shift induced for the oscillation of the main oscillator. On the other hand, once the synchronisation has been established, the braking pulses take place in the vicinity of the end positions of this oscillation wherein the braking effect is greatest.

Figure 21:
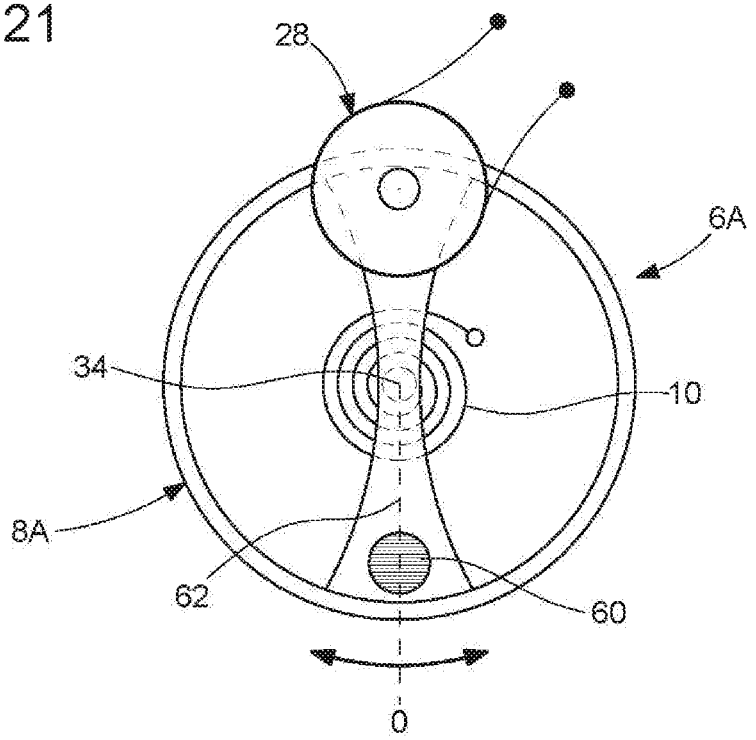
FIG. 21 shows schematically the mechanical oscillator and the electromagnetic device of a second embodiment, FIG. 22 provides, within the scope of the second embodiment, graphs of the progression over time of the angular position of the mechanical oscillator, of the induced voltage in a coil of the electromagnetic device as a function of the control signal of this electromagnetic device in a stationary state.
Figure 22:
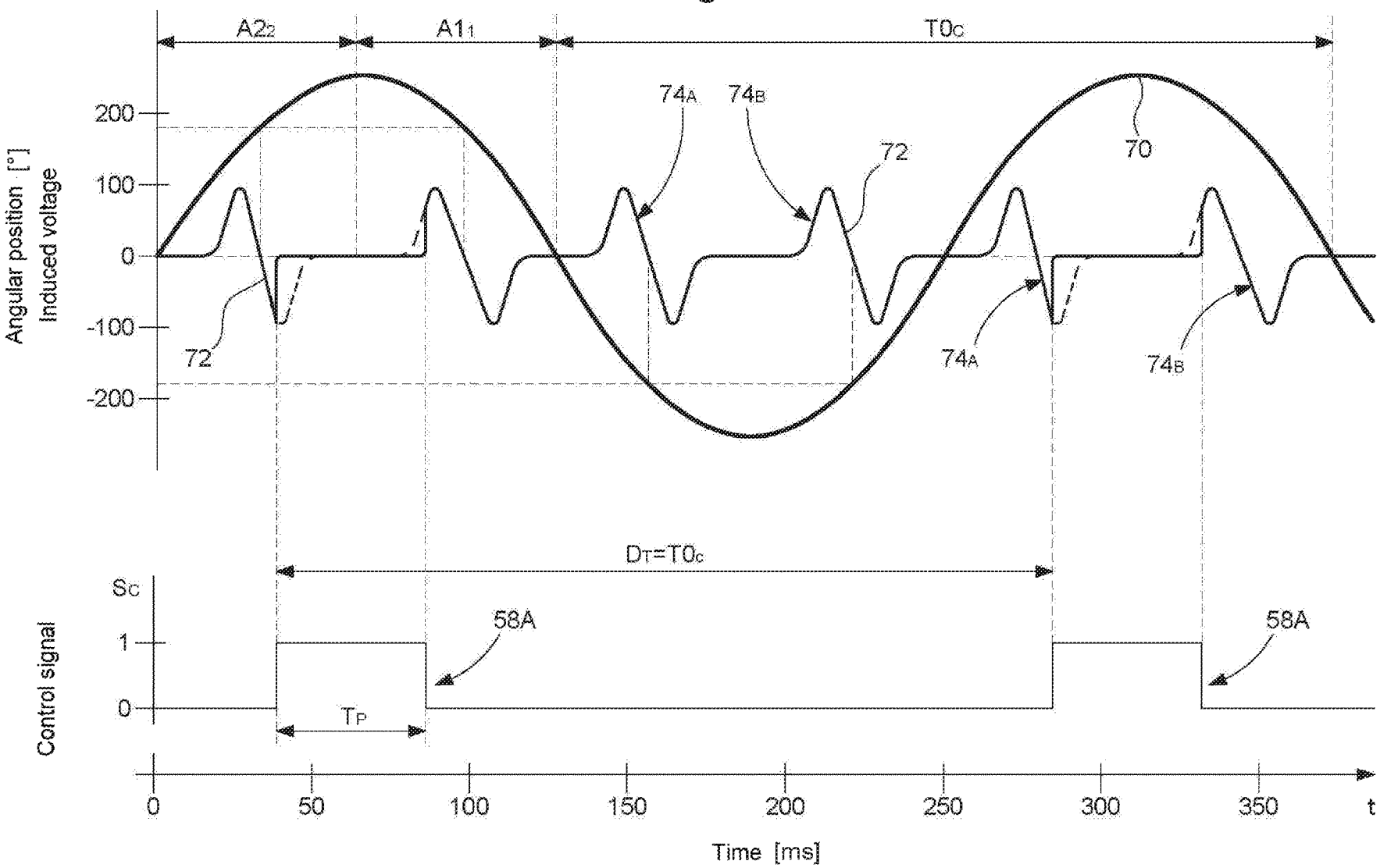

With reference to FIGS. 21 and 22, a first alternative embodiment of a second embodiment of the invention which is surprising by the simplicity of the electromagnetic braking device thereof will be described. This second embodiment differs from the first embodiment essentially by the magnetic system of the electromagnetic braking device which is formed, in the first alternative embodiment, of a single bipolar magnet 60 borne by the balance 8A of the mechanical resonator 6A and, in a second alternative embodiment, by a single pair of bipolar magnets. In the first alternative embodiment, when the resonator 6A is in the neutral position thereof (scenario represented in FIG. 21), a reference half-axis 62 starting from the oscillation axis 34 and passing via the centre of the magnet 60 defines a zero angular position ('0') in a system of polar coordinates centred on the oscillation axis and fixed relative to the plate of the timepiece movement. The coil 28, which completes the electromagnetic braking device in addition to the magnetic system, is rigidly connected to the plate and has an angular lag relative to the zero angular position. Preferably, the angular lag of the coil equals substantially 180°, as represented in FIG. 21.

In FIG. 22 are represented the curve 70 of the angular position of the balance 8A as a function of time, within the usable operating range of the mechanical oscillator in question which exhibits within this range an amplitude greater than 180° and preferably greater than 200° (scenario shown), and the curve 72 of the induced voltage in a synchronous phase of the operation of the synchronisation device. Thus, in each alternation of the oscillation of the mechanical resonator 6A, two induced voltage pulses $\mathbf{74}_A$ and $\mathbf{74}_B$ having substantially the shape of a sine period are observed. It is observed that the pulses $\mathbf{74}_A$ and $\mathbf{74}_B$ are separated pairwise by time zones with no induced voltage in the coil 28. In an alternative embodiment ensuring great stability in the running of the timepiece, the distinct time intervals $T_P$, defined by the short-circuit pulses 58A generated at the set-point frequency $F0_C$ and thus occurring in each oscillation period, are substantially equal to or greater (scenario shown) than the time zones with no induced voltage in the coil about the two end positions of the mechanical resonator within the usable operating range. However, as will be seen hereinafter, this condition is not necessary, as the time intervals $T_P$ may be less than the duration of these time zones with no induced voltage.

It is observed that, for all that the natural time drift of the timepiece remains within a nominal range for which the synchronisation device has been designed and generally after a transitory phase following the activation of the synchronisation device, this timepiece enters a stable and synchronous phase and where the mechanical oscillator exhibits the set-point frequency $F0_C$ at which are generated herein the short-circuit pulses 58A, regardless of the angular position of the balance 8A during a first short-circuit pulse. FIG. 22 corresponds to a scenario where the natural oscillation frequency F0 of the mechanical oscillator is slightly less than the set-point frequency $F0_C$. It results from this scenario that, in each oscillation period $T0_C$, a first distinct braking pulse, which is generated in the initial zone of each short-circuit pulse by an induced voltage pulse $\mathbf{74}_A$ and which occurs in the second half-alternation $A2_2$ of the second alternation A2 (at the start of the distinct time intervals $T_P$), is stronger than a second distinct braking pulse which is generated in the final zone of each short-circuit pulse by an induced voltage pulse $\mathbf{74}_B$ and which occurs in the first half-alternation $A1_1$ of the first alternation A1 (at the end of the distinct times intervals $T_P$). Two braking pulses are distinct when they are separated by a time interval having a duration different to zero.

Thus, in the synchronous phase, during each time interval $T_P$ where a short-circuit of the coil occurs, the positive phase shift generated by the voltage pulse $\mathbf{74}_B$ in each half-alternation $A2_2$ is greater than the negative phase shift generated by the voltage pulse $\mathbf{74}_A$ in each half-alternation $A1_1$, such that a correction of the running of the timepiece occurs herein in each oscillation period to carry out the synchronisation of the mechanical oscillator on the reference time base. As mentioned above, the generation of the short-circuit pulses at the set-point frequency is a particular scenario. In a further alternative embodiment, short-circuit pulses are generated with a lower frequency corresponding to a fraction of the set-point frequency. More generally, it is envisaged that the time distance $D_T$, separating the same characteristic time of any two successive short-circuit pulses, fulfils the mathematical relation $D_T=M\cdot T0_C/2$, M being any positive whole number. Thus, in the case of a periodic generation of braking pulses, the triggering frequency $F_D$ of these braking pulses is selected to fulfil the mathematical relation $F_D=2\cdot F0_C/M$ (note that the two distinct braking pulses, generated in each time interval $T_P$ respectively upon the appearance of the two induced voltage pulses $\mathbf{74}_A$ and $\mathbf{74}_B$, are considered together as the same braking pulse in terms of the time distances and the triggering frequency). Those skilled in the art will be able to select a sufficiently high frequency, and therefore a value of M that is not too high, to carry out the desired synchronisation.

In a second alternative embodiment of the second embodiment, the electromagnetic braking device comprises a magnetic system formed by a pair of permanent magnets with axial magnetisation and opposite polarities, these two magnets are arranged symmetrically with respect to a reference half-axis of the balance and close enough to one another to add two induced voltage lobes that they generate respectively when this pair of magnets passes opposite the coil. The reference half-axis defines a zero angular position when the mechanical resonator is in the neutral position thereof. The coil exhibits an angular lag relative to the zero angular position such that an induced voltage in this coil occurs, when the mechanical oscillator oscillates in the usable operating range, at least in an alternation of each oscillation period substantially before or after the passage of the mechanical resonator via the neutral position thereof in this alternation. The angular lag of the coil is also preferably equal to 180°. The end angular positions of the mechanical resonator in the usable operating range are, in absolute values, greater than the angular lag which is defined as the minimum angular distance between the zero angular position and the angular position of the centre of the coil. This second alternative embodiment corresponds to the electromagnetic device represented in FIG. 23, but without the second pair of magnets 66, 67 which relates to the third embodiment which will be described hereinafter.

Figure 23:
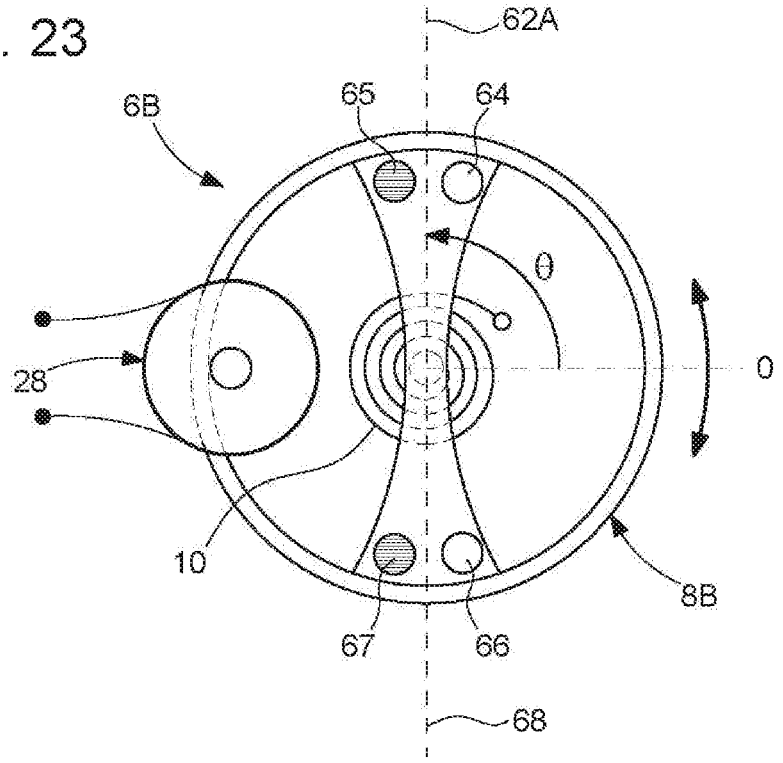
FIG. 23 shows schematically the mechanical oscillator and the electromagnetic device of a third embodiment, FIG. 24 provides, within the scope of the third embodiment, graphs of the progression over time of the angular position of the mechanical oscillator, of the induced voltage in a coil of the electromagnetic device as a function of the control signal of this electromagnetic device in a stationary state.
Figure 24:
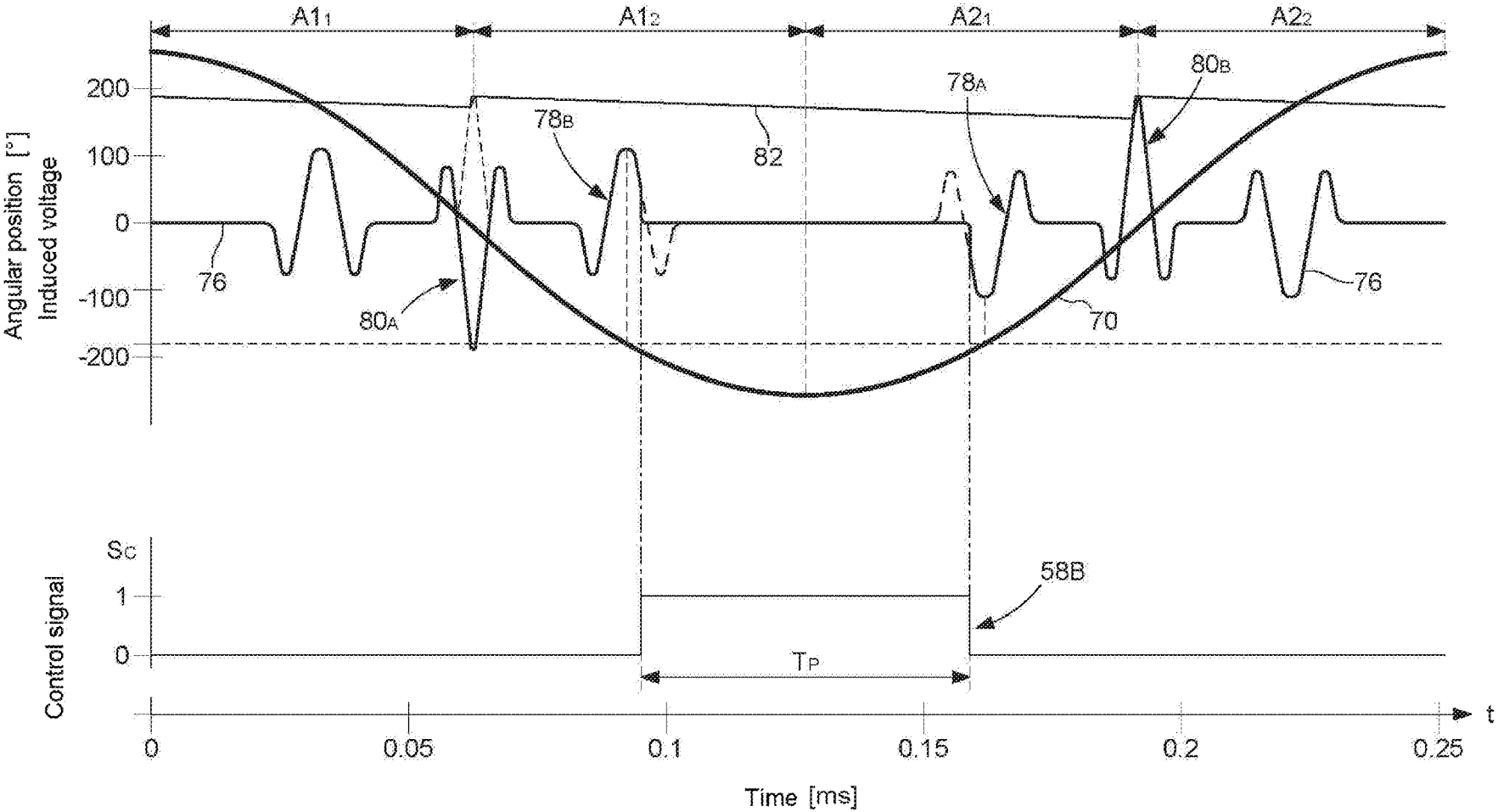
Figure 25:
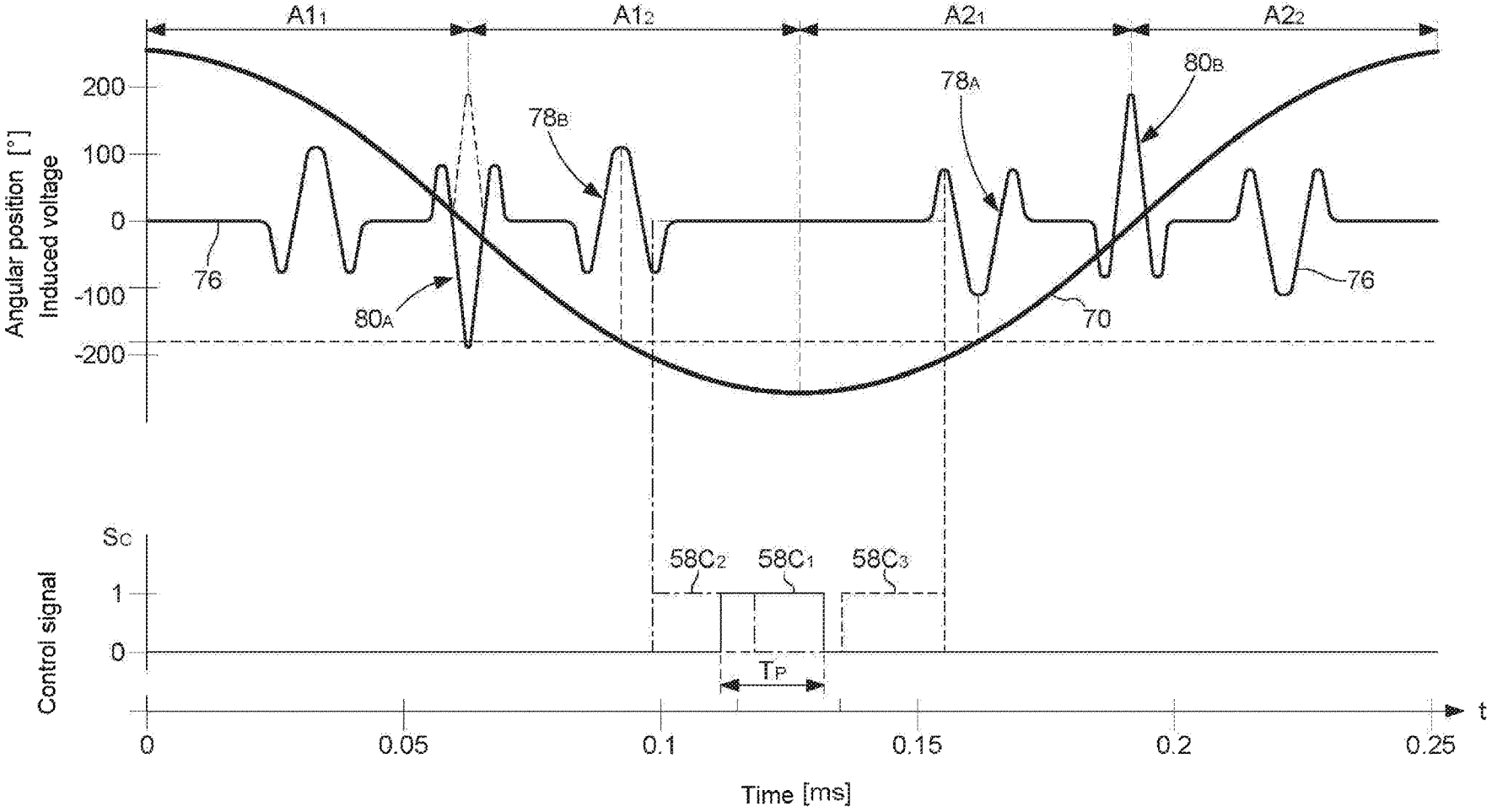
FIG. 25 is similar to FIG. 24 for an alternative embodiment of control of the electromagnetic device within the scope of the third embodiment.
Figure 26:
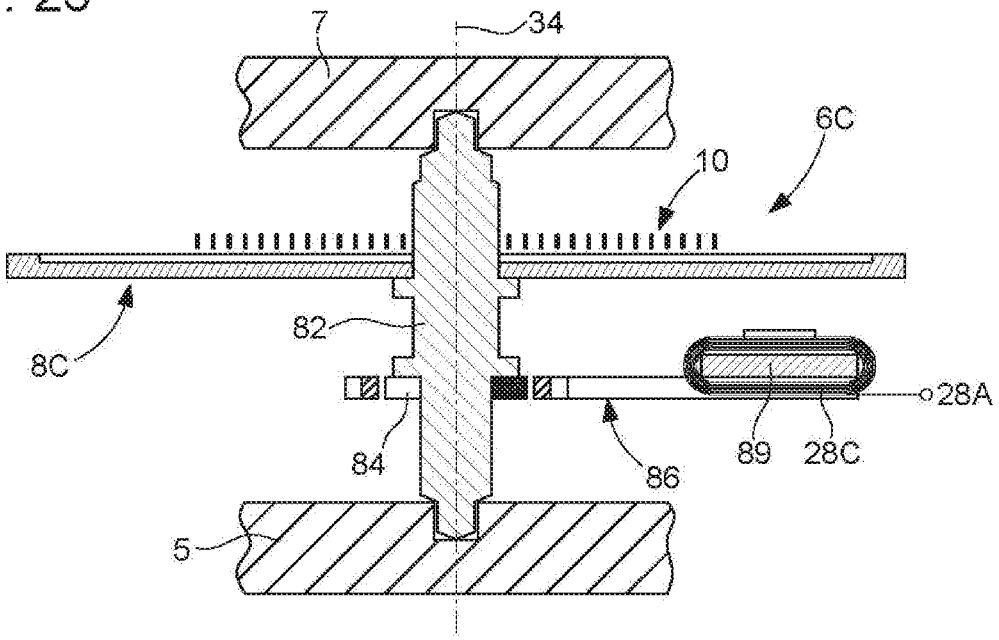
FIG. 26 is a cross-sectional view of the mechanical oscillator and the electromagnetic device of a fourth embodiment.
Figure 27:
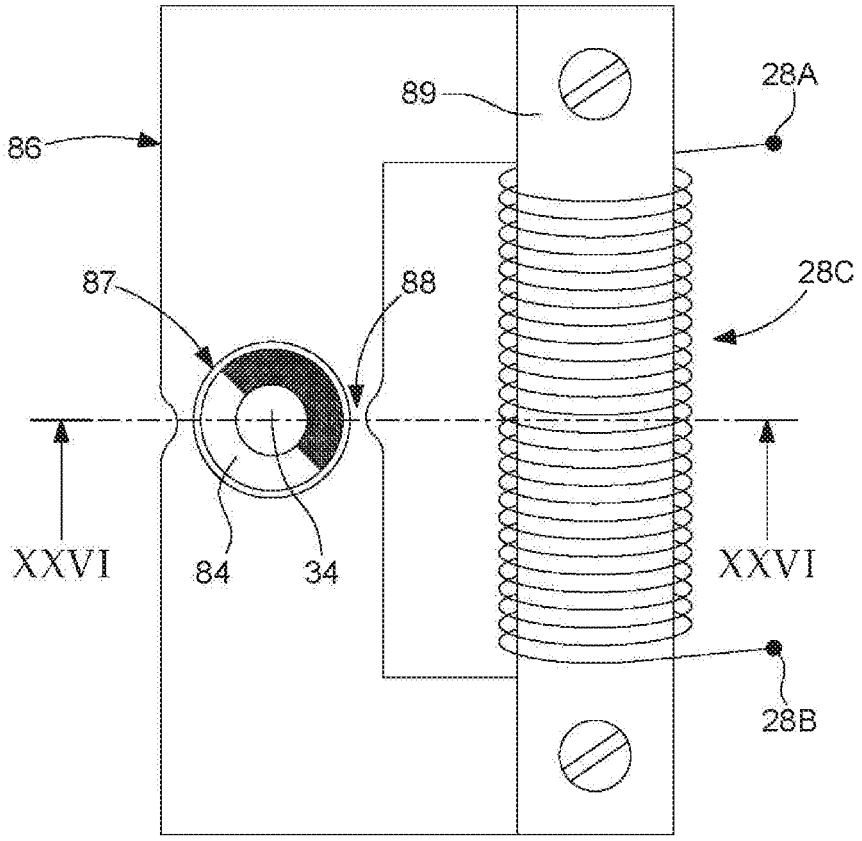
FIG. 27 is a transverse cross-section, along the line A-A of the mechanical oscillator and the electromagnetic device of FIG. 26, and FIGS. 28A, 28B and 28C are graphs providing the progression over time of various physical parameters of the mechanical oscillator and of the synchronisation device of the fourth embodiment for various relations between the set-point frequency $F0_C$ and the natural frequency F0 of the mechanical oscillator, respectively $F0>F0_C$, $F0<F0_C$, $F0=F0_C$.

In a third embodiment, represented in FIGS. 23 to 25, the magnetic system of the electromagnetic braking device consists of a first pair of bipolar magnets 64, 65 and a second pair of bipolar magnets 66, 67 both borne by the balance 8B of the mechanical resonator 6B, as well as a coil 28. Each pair of magnets has an axial magnetisation of opposite polarities. The two magnets of the first pair are arranged symmetrically relative to a reference half-axis 62A of the balance 8B, this reference half-axis defining a zero angular position when the mechanical resonator is in the neutral position thereof. In FIG. 23, it should be noted that the balance is in an angular position θ equal to 90° (θ=90°). The coil 28, as in the second embodiment, exhibits an angular lag relative to the zero angular position, this lag being preferably substantially equal to 180; but further angular lags may be envisaged in further alternative embodiments. The induced voltage curve 76 generated in the coil when the mechanical resonator oscillates is represented in FIG. 24, overlaid on the curve 70 giving the angular position of the balance 8B.

The positioning of the coil 28 at an angle of 180° (alternative embodiment represented in FIG. 23) is a preferred alternative embodiment, as the electromagnetic system formed by the coil with the first pair of magnets 64, 65 generates in each alternation two induced voltage pulses $\mathbf{78}_A$ and $\mathbf{78}_B$ having a symmetry relative to the time of the passage of the resonator 6B by the neutral position thereof. Therefore, there is a pulse $\mathbf{78}_A$ in each first half-alternation $A1_1$, $A2_1$ and a pulse $\mathbf{78}_B$ in each second half-alternation $A1_2$, $A2_2$. Thus, the induced voltage pulses $\mathbf{78}_A$ and $\mathbf{78}_B$ have substantially the same amplitude and are each situated at the same time distance from a passage of the mechanical resonator 6B via an end angular position, such that they are suitable for generating, during a coil short-circuit, a braking torque of the same intensity and phase shift, positive or negative depending on the case, of the same value in the oscillation of the mechanical resonator. Then, as described above, it should be noted that an angular lag of 180° has in addition the advantage of a high efficiency for the braking pulses generated. Furthermore, it should be noted that the amplitude of the balance within the usable operating range of the mechanical oscillator is conventionally envisaged greater than 180°, which therefore enables the generation of the induced voltage pulses and thus the ability to generate braking pulses, by a decrease in the impedance between the two terminals of the coil 28 to correct the running of the timepiece.

In a first alternative embodiment represented in FIG. 24, the value of the distinct time intervals $T_P$ is substantially equal to or greater than the duration of a time zone with no induced voltage in the coil 28 about each end angular position of the mechanical resonator within the usable operating range of the mechanical oscillator. However, this value of the distinct time intervals $T_P$ is envisaged less than the set-point half-period, i.e. $T_P<T0_C/2$. In the synchronous phase of the synchronisation method according to this first alternative embodiment, the short-circuit pulses 58B are aligned between two induced voltage pulses $\mathbf{78}_A$, $\mathbf{78}_B$ encompassing an end angular position and two distinct braking pulses occur respectively at the start and at the end of each time interval $T_P$, these two distinct braking pulses corresponding to two quantities of energy drawn from the mechanical resonator which are variable (the variation of one being opposite the variation of the other, such that if one of the two quantities of energy increases or decreases, the other respectively decreases or increases), according to a positive or negative time drift of the mechanical oscillator in question. It should be noted that FIG. 24 corresponds to the particular scenario where the natural frequency of the mechanical oscillator is equal to the set-point frequency, such that the two quantities of energy mentioned above are herein identical.

In FIG. 25, similar to FIG. 24, a second alternative embodiment is represented wherein the value of the distinct time intervals $T_P$ is less than the duration of a time zone with no induced voltage in the coil 28 about each end angular position of the mechanical resonator. The desired synchronisation is also obtained. Indeed, in the synchronous phase, the short-circuit pulses 58C also remain in a time window which is framed by two induced voltage pulses $\mathbf{78}_A$, $\mathbf{78}_B$ encompassing an end angular position. The time position of the distinct time intervals $T_P$ may vary within this time window during at least an end part of the transitory phase (pulse $\mathbf{58}C_1$) or in the synchronous phase if the natural frequency of the mechanical oscillator is very similar to the set-point frequency, particularly if it varies very slightly about this value. Generally, there is observed in the synchronous phase, according to whether the time drift of the mechanical oscillator is negative or positive, short-circuit pulses $\mathbf{58}C_2$ or $\mathbf{58}C_3$ which occur respectively in the half-alternations $A1_2$ and $A2_1$ of oscillation periods partially simultaneously respectively with the induced voltage pulses $\mathbf{78}_B$ and $\mathbf{78}_A$, such that they generate braking pulses in the respective half-alternations. Only the electromagnetic system mentioned above, formed of the coil and the first pair of magnets, intervenes to carry out the desired synchronisation in the synchronous phase of the synchronisation method, the second pair of magnets then having no impact for this synchronisation method.

The second pair of bipolar magnets 66, 67, which is coupled momentarily with the coil 28 in each alternation of the oscillation of the mechanical resonator, serves essentially for the electrical power supply of the synchronisation device, although it may intervene in a transitory phase (initial phase after activation of the synchronisation device) of the synchronisation method. The timepiece comprises a power supply circuit, formed by a rectifier circuit of an induced voltage in the coil and a storage capacitor, and the second pair of bipolar magnets has a midpoint half-axis 68 between the two magnets thereof which is offset by the angular lag exhibited by the coil 28 relative to the reference half-axis 62A, such that this midpoint axis is aligned on the centre of the coil when the mechanical resonator is in the idle position thereof. The power supply circuit is connected, on one hand, to a terminal of the coil and, on the other, to a reference potential of the synchronisation position at least periodically when the mechanical resonator passes via the neutral position thereof, but preferably constantly. The second pair of magnets generates induced voltage pulses $\mathbf{80}_A$ and $\mathbf{80}_B$ upon the passages of the balance 8B via the zero angular position, these pulses having a greater amplitude than the pulses generated by the first pair of magnets and serving for the power supply of the storage capacitor, the voltage whereof is represented by the curve 82 in FIG. 24.

With reference to FIGS. 26, 27 and 28A-28C, a fourth embodiment of the invention will be described hereinafter. This fourth embodiment differs from the other embodiments essentially by the arrangement of the magnetic system. The shaft 82 of the balance 8C is pivoted between the plate 5 and a balance bridge 7 about the oscillation axis 34. A bipolar magnet 84 with radial magnetisation is arranged on the shaft 82 and placed in an opening 87 of a plate 86 made of material of high magnetic permeability, particularly of ferromagnetic material. The plate 86 defines a magnetic circuit with a core 89 about which is arranged a coil 28C, in the manner of a conventional timepiece motor. The plate 86 has two isthmuses 88 at the level of the opening 87 which partially prevent the magnetic flux from the magnet closing onto itself without passing via the coil core. However, preferably, these isthmuses are envisaged less thin than in the case of a timepiece motor to limit the variation of magnetic potential energy of the permanent magnet 84 according to the angle of rotation thereof.

Figure 28A:
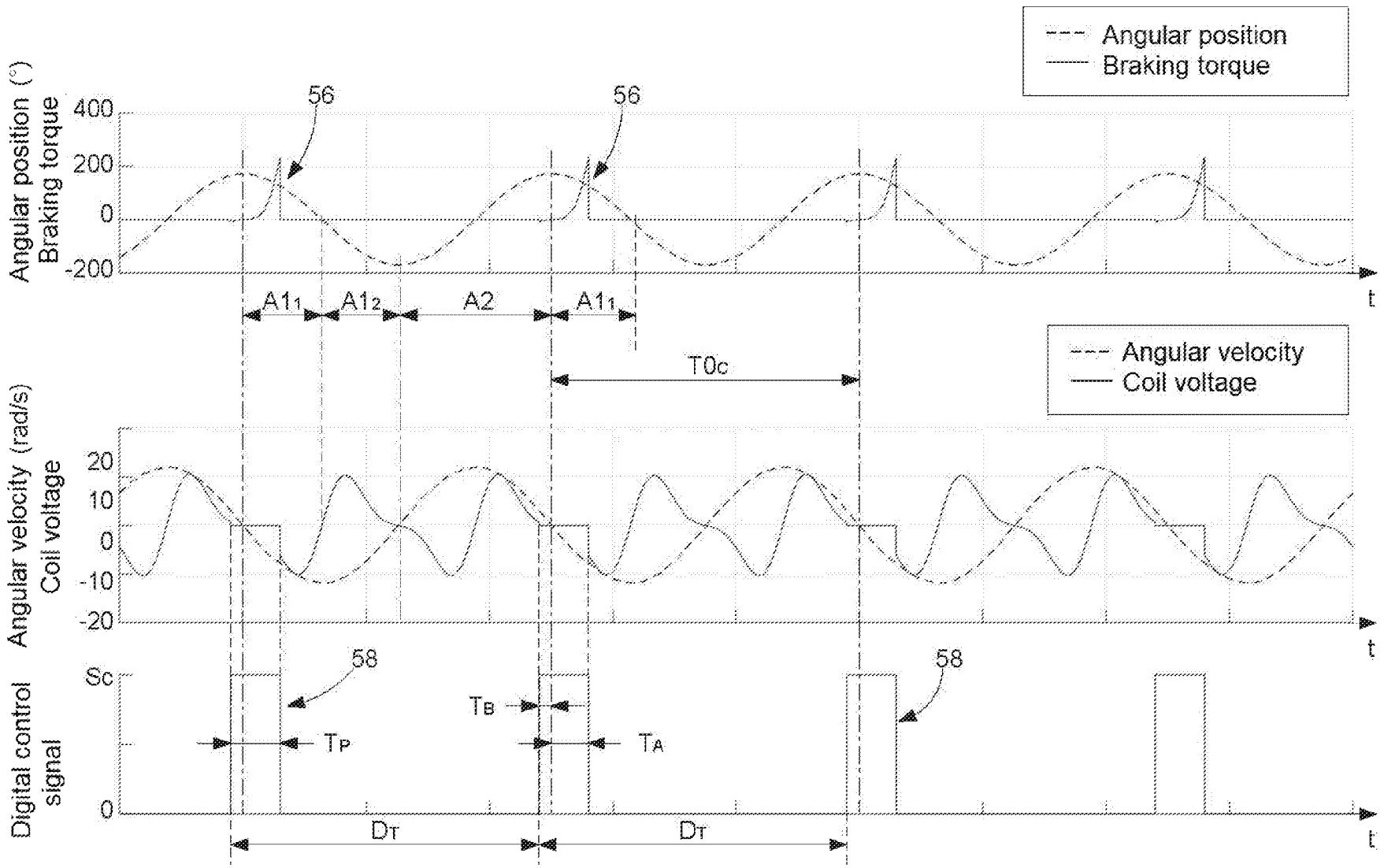
Figure 28B:
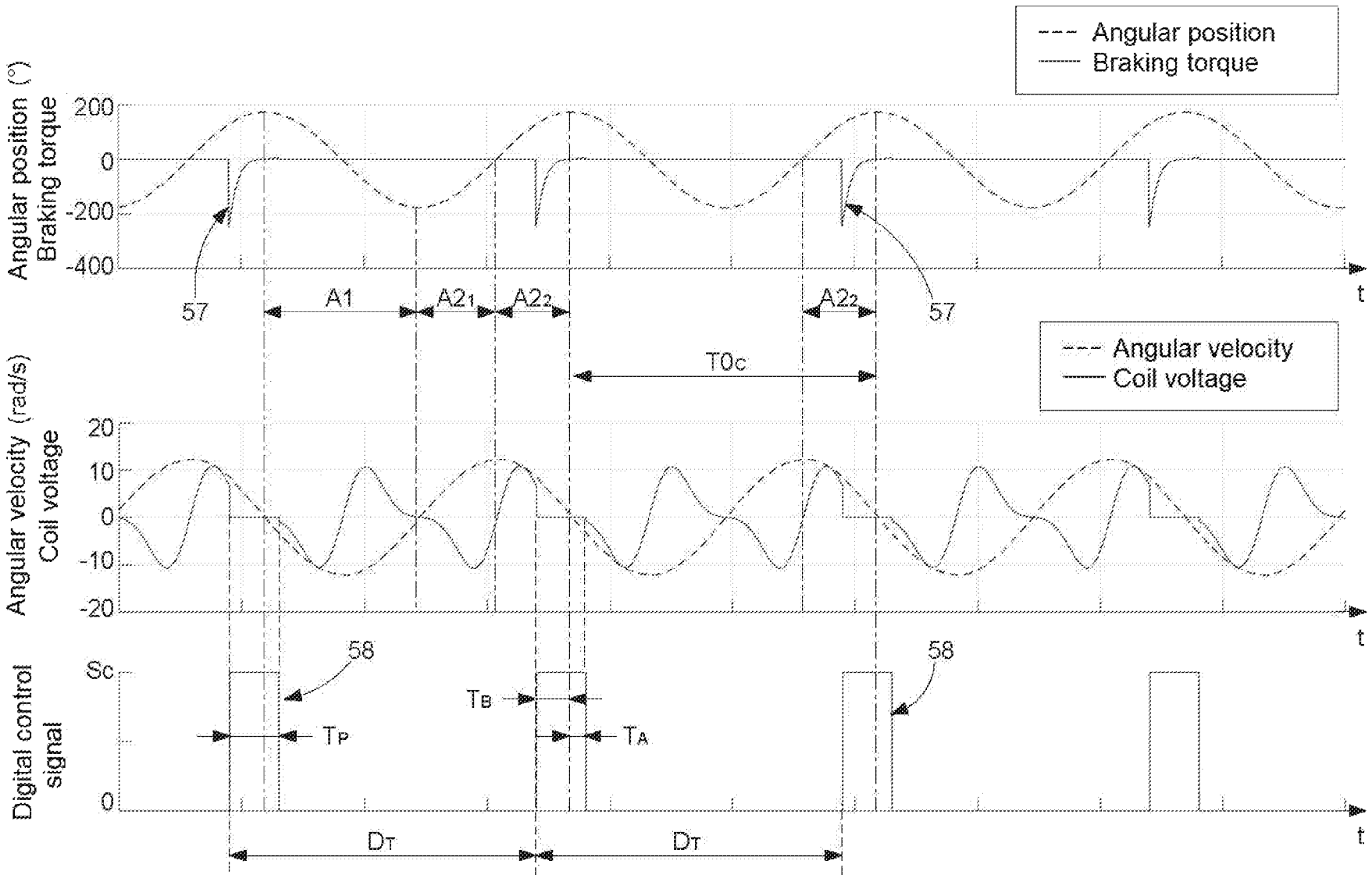
Figure 28C:
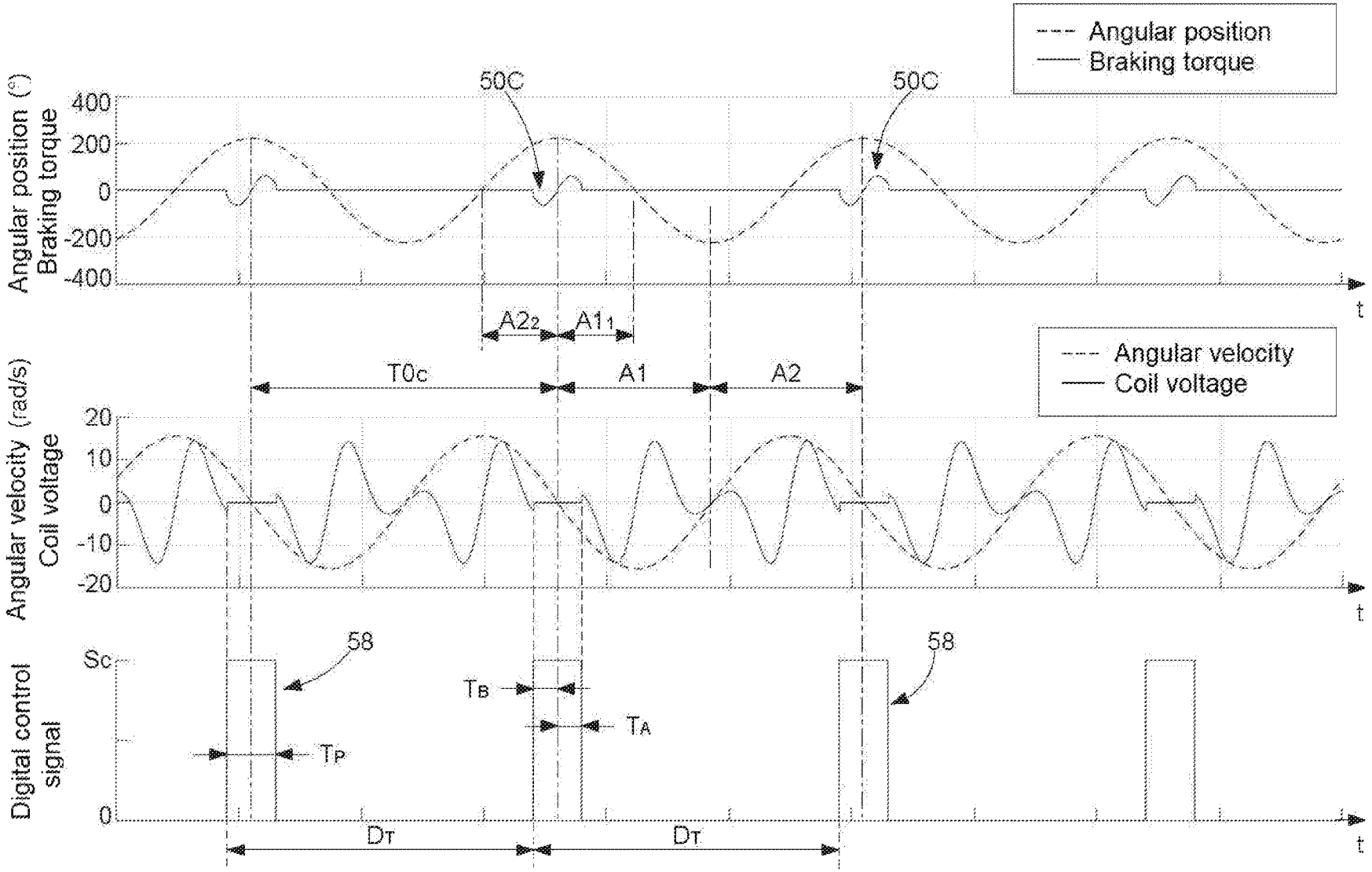

FIGS. 28A to 28C are similar to FIGS. 5A to 5C, but for the fourth embodiment. The induced voltage curve in FIGS. 28A and 28B corresponds to a particular scenario where the oscillation amplitude is substantially equal to 180°. For a greater amplitude, the induced voltage curve in the coil 28C corresponds to the curve represented in FIG. 28C. The latter figure relates to a particular scenario where the natural oscillation frequency F0 of the mechanical oscillator is equal to the set-point frequency. As the braking generated by the braking pulses 50C is weak, the oscillation amplitude of the resonator 6C is slightly greater than that arising in FIGS. 28A and 28B where the braking pulses 56, respectively 57 induce more substantial braking. The pulses 50C do not induce a time phase shift in the oscillation of the mechanical resonator, given that they have a central symmetry relative to the time of the passage of the resonator 6C via an end angular position on the graph of the braking torque. It should be noted that the two parts $T_B$ and $T_A$ of the distinct time intervals $T_P$, arising respectively on both sides of the time of the passage of the resonator 6C via an end angular position, are herein equal since the natural frequency is equal to the set-point frequency. Thus, the adjacent half-alternations $A2_2$ and $A1_1$ have the same duration.

As a reminder, the time intervals $T_P$ are defined by the short-circuit pulses 58 which have between the respective starts thereof a time distance $D_T$ determined by the reference time base. In the present example, the short-circuit pulses 58 are generated with a triggering frequency $F_D$ equal to the set-point frequency, such that the time distances $D_T$ are herein equal to a set-point period $T0_C$.

In the case of a natural frequency F0 that is too high, the first part $T_B$ of the distant time intervals $T_P$ is less than the second part $T_A$ and the braking pulses 56 generated during these distant time intervals, by the corresponding short-circuit pulses, occur substantially in first half-alternations $A1_1$ (almost entirely in the specific example represented), such that they reduce the frequency of the mechanical oscillator to synchronise same on the auxiliary oscillator of the reference time base and thus apply the set-point frequency $F0_C$ to this mechanical oscillator. In the case of a natural frequency F0 that is too low, the first part $T_B$ of the distant time intervals $T_P$ is greater than the second part $T_A$ and the braking pulses 57 generated during these distant time intervals, by the corresponding short-circuit pulses, occur substantially in second half-alternations $A2_2$ (also almost entirely in the specific example represented), such that they increase the frequency of the mechanical oscillator to synchronise same on the auxiliary oscillator.

The invention claimed is:

1. A timepiece, comprising:

a mechanical movement which comprises an indicator mechanism of at least one time data item, a mechanical resonator configured to oscillate along an oscillation axis about a neutral position corresponding to the minimum potential energy state thereof, a maintenance device of the mechanical resonator forming therewith a mechanical oscillator that is arranged to time a running of the indicator mechanism, and an auxiliary oscillator forming a reference time base and determining a set-point frequency $F0_C$ for the mechanical resonator, an inverse of said set-point frequency defining a set-point period $T0_C$; and a synchronization device configured to slave a medium frequency of the mechanical oscillator on said set-point frequency, the synchronization device comprising an electromagnetic braking device of the mechanical resonator, said electromagnetic braking device being formed of a coil and at least one permanent magnet, which are arranged such that, within a usable operating range of the mechanical oscillator, an induced voltage is generated between two terminals of the coil in each alternation of said oscillation, the synchronization device being configured to momentarily reduce an impedance between the two terminals of the coil, wherein the electromagnetic braking device is arranged such that the induced voltage is generated in the coil substantially continuously for any oscillation of the mechanical resonator within the usable operating range of the mechanical oscillator, wherein the synchronization device is further configured to reduce the impedance between the two terminals of the coil during distinct time intervals $T_P$ such that starts of any two successive time intervals $T_p$, among said distinct time intervals Tp, exhibit therebetween a time distance $D_T$ equal to a positive whole number N multiplied by half of the set-point period $T0_C$ for the mechanical oscillator, such that a mathematical relation $D_T = N \cdot T0_C/2$ is satisfied, and the synchronization device is further configured to determine, with the reference time base, a start of each of the distinct time intervals so as to fulfil the mathematical relation between the time distance $D_T$ and the set-point period $T0_C$.

2. The timepiece according to claim 1, wherein the synchronization device is further configured to trigger periodically said distinct time intervals $T_P$, which have a same value, such that the triggering frequency $F_D$ is equal to twice the set-point frequency $F0_C$, equal by definition to the inverse of the set-point period $T0_C$, divided by a positive whole number M, such that $F_D=2\cdot F0_C/M$, the value of the distinct time intervals $T_P$ being less than the set-point half-period, so that $T_P<T0_C/2$.

3. The timepiece according to claim 1, wherein the mechanical resonator is formed by a balance oscillating about the oscillation axis.

4. The timepiece according to claim 3, wherein the balance bears said at least one permanent magnet, and a support of the mechanical resonator bears the coil.

5. The timepiece according to claim 1, wherein a value of the distinct time intervals $T_P$ is less than one quarter of the set-point period $T0_C$, so that $T_P<T0_C/4$.

6. The timepiece according to claim 4, wherein the electromagnetic braking device further comprises a magnetic system borne by the balance and formed by a pair of bipolar magnets with axial magnetization and opposite polarities, said pair of bipolar magnets being arranged symmetrically relative to a reference half-axis of the balance, said reference half-axis defining a zero angular position when the mechanical resonator is in the neutral position thereof; and wherein said coil exhibits an angular lag relative to the zero angular position such that the induced voltage in said coil occurs substantially, when the mechanical oscillator oscillates in the usable operating range, in each alternation alternately before and after passage of the mechanical resonator via the neutral position thereof in said alternation, end angular positions of the mechanical resonator in said usable operating range being, in absolute values, greater than said angular lag, which is defined as a minimum angular distance between the zero angular position and the angular position of a center of the coil.

7. The timepiece according to claim 6, wherein, within the usable operating range of the mechanical oscillator, the distinct time intervals $T_P$ are substantially equal to or greater than time zones with no induced voltage in said coil about the two end angular positions of the mechanical resonator.

8. The timepiece according to claim 6, wherein said angular lag is substantially equal to 180°.

9. The timepiece according to claim 1, further comprising a power supply circuit formed by a storage capacitor and by a rectifier circuit of a voltage induced in the coil by the at least one permanent magnet when the mechanical resonator oscillates.

10. The timepiece according to claim 9, wherein the power supply circuit is constantly connected to a terminal of said coil and to a reference potential of the synchronization device; and wherein said at least one permanent magnet generating the induced voltage rectified by the rectifier circuit and the coil and the power supply circuit are arranged such that, in the usable operating range of the mechanical oscillator, the electrical energy stored in the storage capacitor is sufficient to power the synchronization device.

11. The timepiece according to claim 6, further comprising a power supply circuit formed by a storage capacitor and by a rectifier circuit of a voltage induced in the coil by a further pair of permanent magnets when the mechanical resonator oscillates, the further pair of permanent magnets having a midpoint axis between the further pair of permanent magnets thereof and being momentarily coupled with the coil in each alternation of the oscillation of the mechanical resonator, said midpoint axis being substantially offset by said angular lag relative to said reference half-axis such that said midpoint axis is substantially aligned on the center of the coil when the mechanical resonator is in the neutral position thereof; and wherein the power supply circuit is connected to a terminal of said coil and to a reference potential of the synchronization device at least periodically when the mechanical resonator passes via the neutral position thereof.

12. The timepiece according to claim 1, wherein the synchronization device is further configured to generate a short-circuit between the two terminals of said coil during said distinct time intervals.

13. The timepiece according to claim 2, wherein the synchronization device is further configured to generate a short-circuit between the two terminals of said coil during said distinct time intervals.

14. The timepiece according to claim 5, wherein the synchronization device is further configured to generate a short-circuit between the two terminals of said coil during said distinct time intervals.

* * * * *